US007191489B1

(12) United States Patent
Heath

(10) Patent No.: US 7,191,489 B1
(45) Date of Patent: Mar. 20, 2007

(54) INTEGRATED CLEANING APPARATUS

(76) Inventor: Glenn R. Heath, 14555 Philippine St. #226, Houston, TX (US) 77040

( * ) Notice: Subject to any disclaimer, the term of this patent is extended or adjusted under 35 U.S.C. 154(b) by 511 days.

(21) Appl. No.: 10/388,247

(22) Filed: Mar. 12, 2003

(51) Int. Cl.
*B08B 9/27* (2006.01)
*B08B 9/04* (2006.01)
*A47L 11/30* (2006.01)

(52) U.S. Cl. ..... 15/320

(58) Field of Classification Search ..... 15/302, 15/320, 321; 134/198
See application file for complete search history.

(56) References Cited

U.S. PATENT DOCUMENTS

| | | | | |
|---|---|---|---|---|
| 3,968,938 | A * | 7/1976 | Ruhl et al. | 241/101.1 |
| 4,158,248 | A * | 6/1979 | Palmer | 15/321 |
| 4,940,082 | A * | 7/1990 | Roden | 15/321 |
| 5,003,998 | A * | 4/1991 | Collett | 134/22.12 |
| 5,287,589 | A * | 2/1994 | Hughes | 15/321 |
| 5,317,782 | A * | 6/1994 | Matsuura et al. | 15/324 |
| 5,428,862 | A * | 7/1995 | Sailer | 15/321 |
| 5,706,932 | A * | 1/1998 | White | 198/495 |
| 5,735,018 | A * | 4/1998 | Gallagher et al. | 15/405 |
| 6,009,595 | A * | 1/2000 | Leasure et al. | 15/329 |
| 6,561,745 | B2 * | 5/2003 | Rountree | 414/490 |
| 2004/0231089 | A1 * | 11/2004 | Vilarasau Alegre | 15/319 |

FOREIGN PATENT DOCUMENTS

| | | | |
|---|---|---|---|
| WO | WO 99/13260 | * | 3/1999 |

* cited by examiner

*Primary Examiner*—Terrence R. Till
(74) *Attorney, Agent, or Firm*—Baker, Donelson, Bearman, Caldwell & Berkowitz, PC

(57) ABSTRACT

An integrated apparatus for carpet cleaning, pressure washing, air duct cleaning and inspection, portable welding, moisture abatement and other building maintenance and repair services, in which a gas engine mounts to a frame and has a drive shaft that extends from the gas engine. A blower, an air compressor, an electric generator, and a water pump also mount to the frame, with the water pump for connecting to a supply of water. A flex coupler connects the drive shaft of the gas engine to the blower. Furthermore, endless belts connect the drive shaft of the gas engine to the air compressor, the electric generator, and the water pump. The gas engine drives the blower, the air compressor, the electric generator, and the water pump, for selective configuration and use for carpet cleaning, pressure washing, air duct cleaning and inspection, portable welding, moisture abatement and other building maintenance and repair services. An air mover with integral dolly communicates high velocity air for moisture abatement or duct-cleaning purposes. A video air tool provides imaging of duct cleaning by pressure attachments.

46 Claims, 10 Drawing Sheets

INTEGRATED CLEANING APPARATUS

TECHNICAL FIELD

The present application relates to cleaning apparatus. More particularly, the present invention is directed towards apparatus for performing carpet, drapery and upholstery cleaning, air duct and dryer vent cleaning, and pressure washing hard surfaces such as asphalt, building exteriors, marble, even drain cleaning as well as apparatus for powering air and electric tools and lighting systems for various cleaning, maintenance and repair services.

BACKGROUND OF THE INVENTION

Homes and buildings include a number of different systems which function to facilitate the use of the homes and buildings. For example, among these systems is the HVAC (heating, ventilation, and air conditioning) system, which distributes heated or cooled air throughout the home or building. Electrical systems similarly distribute current and voltage via a network of juncture boxes, wiring, and switches. Plumbing systems handle water supply and discharge. Even the flooring of the home or building may be thought of as a system, in that the carpeting, tile and other floor materials cover the sub floor and both provide an ornamental as well as functional surface for the flooring. Exterior walls are closed to the elements by weather resistant materials, as well as paints and other preparations. Roofing systems are similarly designed.

Periodic cleaning, maintenance and repair of these systems are necessary to provide a comfortable, clean and functional environment in which to work and live, and to obtain satisfactory use life for the systems and associated materials. For example, soils in carpeting and upholstery can detract from their ornamental appearance and cause premature wear, degradation and destruction of the fibers from which they are made.

In HVAC systems, air passes through enclosed channels referred to as air ducts that communicate "supply" air from a central air handler via a centrifugal fan or "blower" to the various rooms in the home or building. Other ducts communicate "return" air from the rooms back to the central air handler for filtering, cooling or heating, and so forth.

The previously mentioned supply air and even more so the return air, ultimately contain dust, debris and microbial contaminates. In particular, the microbes aspergillum, cladosporum and stachybotrys breed the mycotoxins responsible for over 100 known carcinogens existing in the typical HVAC system. Gradually over time, some of these particulates accumulate on the interior walls of the air ducts. Excessive accumulation of these particulates degrades the performance of the air duct system by impeding necessary air flow. Similarly, significant portions of these contaminants can be redistributed to the air supply not withstanding some air is filtration at the central air handler. Many of the above mentioned microbial contaminates are due to the presence of the evaporator coils used in cooling the air, which remain moist in operation and are positioned post filter in the air handler.

Drains and dryer vents also become occluded over time. Kitchen drains will clog with foodstuffs, grease and other waste. Bathroom drains clog with hair, toothpaste and shaving products. Dryer vents, which become occluded with lint over time, are potential fire hazards.

Likewise, the exterior surfaces of the home or building will, over time become significantly contaminated. For example, algae may grow on surfaces which are moist and shaded from sunlight. Soils and contaminates in the air will accumulate and ultimately stain and otherwise degrade the appearance and life of the home or buildings' exterior treatment.

Regular cleaning and maintenance activities eliminate a portion of the above mentioned contaminates. For example, routine vacuuming extracts a significant amount (60 to 70 percent) of the soils from carpeted floor surfaces. However, soil and dirt will accumulate over time as vacuuming is not 100 percent efficient and cannot begin to remove solids or liquids that have changed the color of the carpet fibers. Routinely changing the filters in an HVAC system will help remove airborne soils and particulates, but only to the degree the filter is rated (i.e. 70 percent efficient) and only until the filter becomes loaded with debris. Subsequently, air ducts will build up occluded wall surfaces, particularly the return air ducts which are before any filtration in the HVAC system.

Liquid drain cleaners can dissolve hair, grease and other common debris but the walls of the affected drain will remain partially occluded and the drain will slow or clog again. As a final example, routinely washing a building's exterior surfaces will reduce contaminant buildup. Never the less, a significant amount of mold, rust, smog and the like will accumulate despite the most diligent maintenance activities.

Specialized equipment has been developed to facilitate cleaning beyond ordinary and routine maintenance. Both "low" pressure washing systems (with extraction) for carpet and upholstery cleaning etc. and "high" pressure washing systems (without extraction) for exterior building surfaces, asphalt, etc. are in use. In the "low" pressure systems for carpet and upholstery cleaning, a cleaning agent is first applied to all areas and furthermore brushed into "high traffic" or heavily soiled areas and then hot (160 to 190 degrees F.) water is communicated as a sprayable rinse to carpets and upholstery surfaces, in an effort to extract soils from the fibers. The extraction is achieved by a vacuum pump of high lift (15 inches Hg) and flow (275 to 350 cubic feet per minute) communicated through a nozzle adjacent the sprayable rinse. The sprayable rinse is heated by a water heater (60,000 to 120,000 Btu per hour) and delivered by a water pump (1.6 to 2.2 gallons per minute (gpm) at 300 to 600 psi). Accordingly, the low pressure washing and the adjacent high lift vacuuming facilitates the extraction of the sprayed cleaning agent, the soils, and the rinse water simultaneously. This system is also used, without the sprayable rinse to perform water extraction after a flood etc.

In contrast, the "high" pressure washing systems used on building exteriors and other hard surfaces require substantially more water, pressure and applied heat. The surfaces involved are often permeated by mold, mildew, rust, grease, oil and other contaminates. Larger water pumps capable of higher pressures (2500 to 3000 psi) and flows (4.5 to 5.0 gpm) are required. Furthermore, the applied heat necessary to maintain the proper cleaning temperature (160 to 190 degrees F.) at these higher flow rates exceeds 400,000 Btu/hr. Subsequently, a very large kerosene or propane fueled water heater must be transported by truck or trailer to the job site.

The van mounted cleaning systems designed for carpet and upholstery cleaning are equipped with smaller water pumps and heaters (or heat exchangers), and are not capable of developing the pressures and heat necessary for pressure washing building exteriors, asphalt, drains, etc. Similarly, cleaning systems designed for commercial and residential pressure washing are without the high lift vacuum pump and the necessary waste water reservoir for carpet cleaning and water damage. Obvious space limitations in common service vehicles have created this necessary dichotomy. For now, owners of homes and businesses must hire "carpet cleaners" for carpet cleaning and "pressure washers" for pressure washing because currently, the two services require differently equipped vehicles.

Specialized equipment has also been developed for air duct cleaning. Basically there are two types of systems used by professional air duct cleaners, differing primarily in the proximity of the duct cleaning vacuum (used to capture the various above mentioned contaminates) with respect to the central air handler. Portable electric vacuums can be placed inside the home or building close (10 to 35 feet) to the air handler. Gas powered portable or truck mounted vacuums must be positioned outside the exterior walls of the structure significantly further from the air handler. This dictates much longer hose runs (75 to 150 feet) between the duct cleaning vacuum and the air handler. Transmitting vacuum over such distances creates unwanted static pressure. Subsequently, gas portable or truck mounted vacuums must be more powerful to achieve the same results as portable electric vacuums positioned closer to the air handler. This is not to suggest that any of these vacuums operate better than the others, only to point out the distinct advantage of positioning the vacuum closer to the central air handler.

Conversely, because portable electric vacuums operate on typical household current (20 amp/115 volt) and the associated circuit breakers, they are limited to 1.0 to 1.75 horsepower electric motors for powering their respective "blowers" or vacuum pumps. Some manufacturers build electric portable vacuums with two blowers in tandem to achieve higher levels of vacuum. Each blower must run on a separate distinct circuit. Unfortunately, the two motor approach only results in about a 50 percent increase in air flow (cfm) and no increase whatsoever in static pressure handling capability over the single blower units. Furthermore, the "in rush" or required starting amps for the electric motors running the blowers is about five times their operating or "running amps". Subsequently, starting these electric motors can be problematic, much less operating them on circuits already subjected to every day loads.

The gas powered portables and truck mounted equipment, which operate in the 16 to 60 hp range, do not suffer this limitation. However, their larger engines, weight and size present problems. These devices cannot be brought inside the home or building. In some cases they cannot be situated near the building. The further they are positioned from the air handler the less effective they become.

All of the above systems are implemented in the same manner. A perspective vacuum engages the air handler or handlers (often there is more than one) at two distinct is points. A 10 to 12 inch diameter hole is cut into the plenum either above the evaporator (when addressing the supply vents) or just before the filter (when addressing the return vents). A "furnace flange" is attached here by sheet metal screws or other fasteners. The flange is matched to the diameter of the hole that was cut and provides a "male" fitting for attaching a length of 10 to 12 inch diameter vacuum hose to the air handler. This hose is then attached distally to a male inlet port on the vacuum being used. The hose that attaches the vacuum to the air handler could be as short as 10 feet (ideal) or as long as 150 feet or more. The supply air ducts are isolated (and cleaned separately) from the return air ducts. This is generally accomplished by creating a blockade of sorts at or near the air filter housing.

The dust, debris and contaminants in the air duct system must first be dislodged in order for the vacuum to capture them. This is generally accomplished with compressed air driven cleaning tools. Common air duct cleaning systems will include a portable (150 to 200 lbs) gas or electric air compressor. Such compressors deliver sufficient air (20 to 23 cfm @ 175 psi) to run various tools used in the air duct cleaning process. The gas compressors are generally positioned just outside the home or building. Electric compressors are uncommon because of the previously discussed "in rush" or starting amps they require. A typical 5.0 hp electric compressor operating on 20 amps will require about 100 amps to start. Electric circuits of this amperage are rare in most homes and some buildings.

The most commonly used tool for the agitation and dislodging of the various contaminates in an HVAC system would be the "air whip" pressure attachment. The air whip is supplied with compressed air (typically at 175 psi) and is inserted into the various air ducts by a series of flexible hollow rods. These rods consist of interlocking tubes (typically five-foot sections) that communicate compressed air to the distal end where the air whip is attached and dislodges debris. The air whip is of a flexible rubber and both flagellates and emits jets of compressed air against the walls of the ducts.

Also commonly used are "skipper balls" pressure attachments, which attach to the distal end of a set of the flexible rods or lightweight half inch air hose. These tools are generally round, with 6 to 12 perforations in a circular pattern, pointing fore or aft. "Reverse" skipper balls "pull" debris toward a point where the vacuum can capture it. "Forward" skipper balls "push" debris toward an interface with the vacuum.

Finally, rotary brushes of various diameters are employed, particularly in the cleaning of round duct work. They are generally cable driven (at the distal end of a 20 to 25 foot cable) by an electric drill. A few are air powered by a small air motor at the distal end of a 20 to 25 foot series of hollow flexible rods like those used to manipulate air whips. As with the other tools mentioned, they are designed to dislodge debris, which is then captured by the vacuum.

Some air duct cleaners use video cameras or periscopes to monitor some aspects of an air duct cleaning. However, this practice is not widespread. The bulkiness of the video cameras being used prevents simultaneous cleaning and viewing or deep insertion of the equipment. As well, these cameras will not fit through the one inch diameter holes drilled in the duct walls for inserting air whips and skipper balls. Even the handcart which typically carries the monitor and VCR for recording the video "inspection" is cumbersome to position throughout the building.

Subsequently, most video inspections are done to establish the need for an air duct cleaning rather than for documenting the procedure. A completely monitored air duct cleaning utilizing smaller more maneuverable cameras and more portable recording equipment is needed. This will allow the duct cleaning professional to demonstrate their proficiency to the customer.

Once the vacuum captures the above mentioned debris it must somehow process it. The portable electric vacuums have an integral multi-stage filter system; the final stage being a HEPA (high efficiency particle air) filter that is effective in keeping even the smallest particles from being reintroduced into the home or building. However, these filters are cumulatively restrictive, particularly once they become "loaded" with debris. Air flow falls off logarithmically as static pressure increases. "Annubar" testing done on these machines with clean filters indicates they are only capable of air flows between 1000 and 1500 cubic feet per minute. In a typical 12 inch round duct (with a cross sectional area of 0.79 square feet) this indicates a maximum air velocity of (1500 cfm divided by 0.79 square feet) or 1900 feet per minute (fpm). NADCA (The National Association of Duct Cleaners of America) has stated that air velocities between 3000 and 3500 fpm is minimum are required to transport the dust and debris commonly found in residential and commercial HVAC systems.

Gas portable vacuums and truck mounted vacuum systems generally use either one large cloth collection bag attached directly to the vacuum or a system of several bags partially housed in a truck. These vacuum bags become "loaded" with the same debris as the multi-stage filters mentioned above. As well, inclement weather can affect the performance of a cloth collection bag. A bag becoming soaked with rain loses porosity. This creates static pressure and decreases airflow through the bag. Add these complications to the 75 to 150 feet of vacuum hose needed to engage the plenum, and these typically more powerful vacuums will not perform any better than portable electric systems.

Furthermore, these "portable" vacuums are not entirely portable. The electric portables weigh about 200 pounds and with their multi-stage filters are about the size of a small refrigerator. It requires care and diligence to position them near the air handler. The gas portables weigh about 300 pounds and require two men to load, unload and situate.

While these three air duct cleaning systems extract debris, there are drawbacks and disadvantages to their approaches. In some cases, these systems either fail to reach or fail to sustain the necessary air flows to transport dust and debris. None of the systems discussed incorporates a device for the continuous monitoring of the entire duct cleaning process.

The devices and procedures used for air duct cleaning, carpet and upholstery cleaning and the cleaning of building exteriors and other hard surfaces are documented above. From time to time, home and business owners need other related services. These include services performed with air or electric tools (nailing, stapling, painting, grinding, sanding etc.) or services requiring portable electric power (welding, emergency lighting, moisture abatement, etc.) which are services not typically associated with cleaning systems. Currently, acquiring these services implies relationships with several different contractors. Separate appointments are scheduled on separate days. Separate checks are written and separate warranties made.

While the devices and procedures discussed above are in fact helpful in maintaining the various systems in homes and buildings, there are drawbacks to their use that limit their functionality and effectiveness in accomplishing the cleaning and maintenance tasks for which they are intended. Accordingly, there is a need in the art for an improved integrated cleaning apparatus for the cleaning and maintenance of homes and buildings, which apparatus provides sustainable hot water at appropriate pressures for washing services while fully documenting an air duct cleaning performed at sufficient air velocities to remove the contaminants and providing compressed air and electrical power for running tools of other trades, which is a single source dedicated service apparatus mounted in a van. It is to such that the present invention is directed.

BRIEF DESCRIPTION OF THE PRESENT INVENTION

The present invention meets the need in the art by providing an integrated apparatus for carpet cleaning, air duct cleaning, pressure washing and other services, in which a gas engine mounts to a frame and has a drive shaft that extends from the gas engine. A high lift vacuum pump or "blower", an air compressor, an electric generator and a water pump mount to the frame, with the water pump for connecting to a supply of water. Each of the blower, the air compressor, the electric generator and the water pump has a respective drive shaft and is disposed on the frame. The blower is disposed in opposing relation to the gas engine. The electric generator is disposed directly below the blower in opposing relation to the gas engine and the compressor. The water pump is disposed directly below the electric generator in opposing relation to the compressor. The compressor is disposed directly below the gas engine. A flex coupler connects the drive shaft of the gas engine to the aligned drive shaft of the blower. An endless belt operatively engages to the drive shaft of the gas engine and to the drive shaft of the air compressor. A second endless belt operatively engages to the drive shaft of the blower and to the respective drive shafts of the electric generator and the water pump. The gas engine drives the air compressor, the blower, the electric generator, and the water pump for selective configuration and use for carpet cleaning, air duct cleaning, and pressure washing as well as operating related equipment for those and other services.

Objects, features, and advantages of the present invention will become apparent from a reading of the following detailed description of the invention and claims in view of the appended drawings.

DETAILED DESCRIPTION

Figure 1:
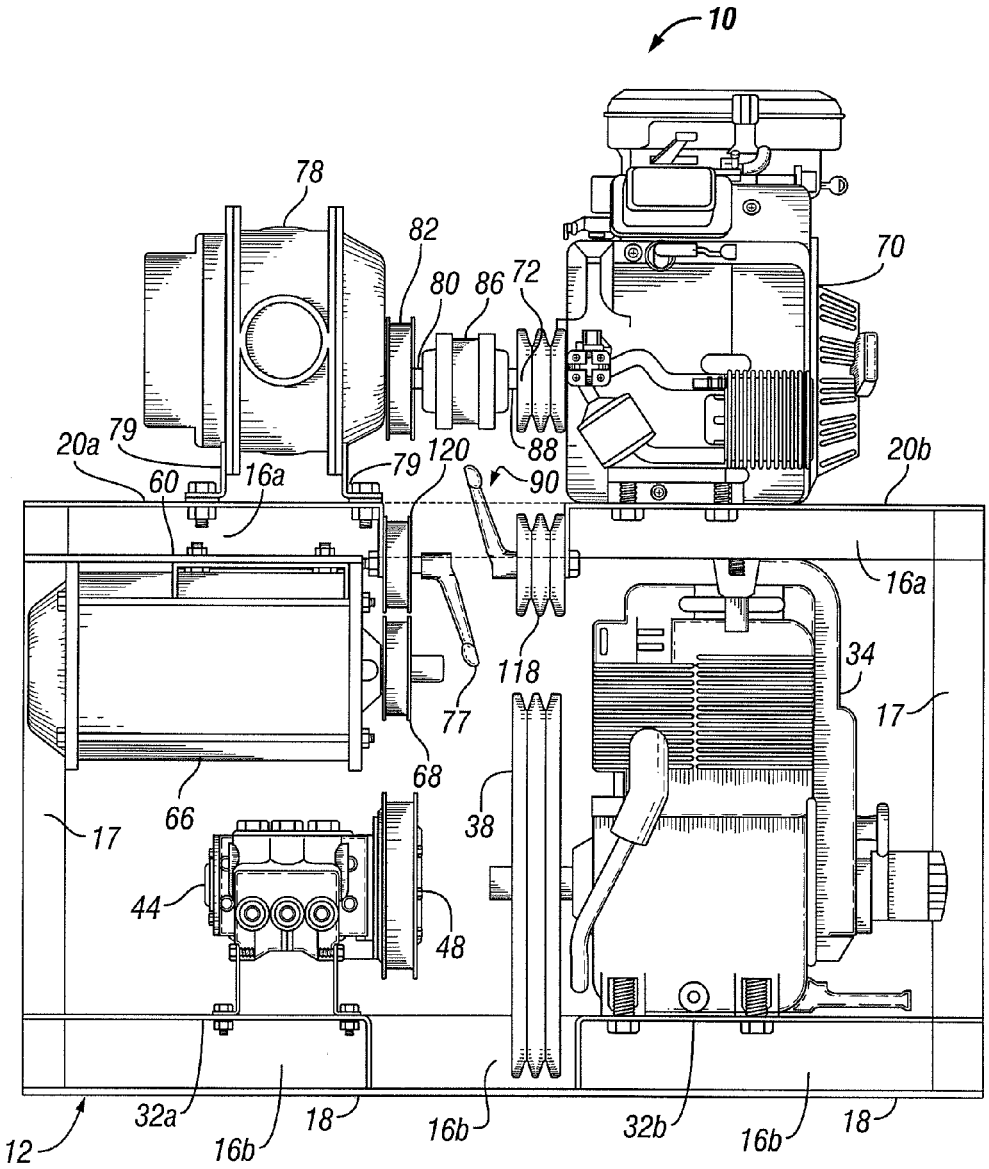
FIG. 1 illustrates a side elevation view of a cleaning apparatus according to the present invention for cleaning and other services.
Figure 8:
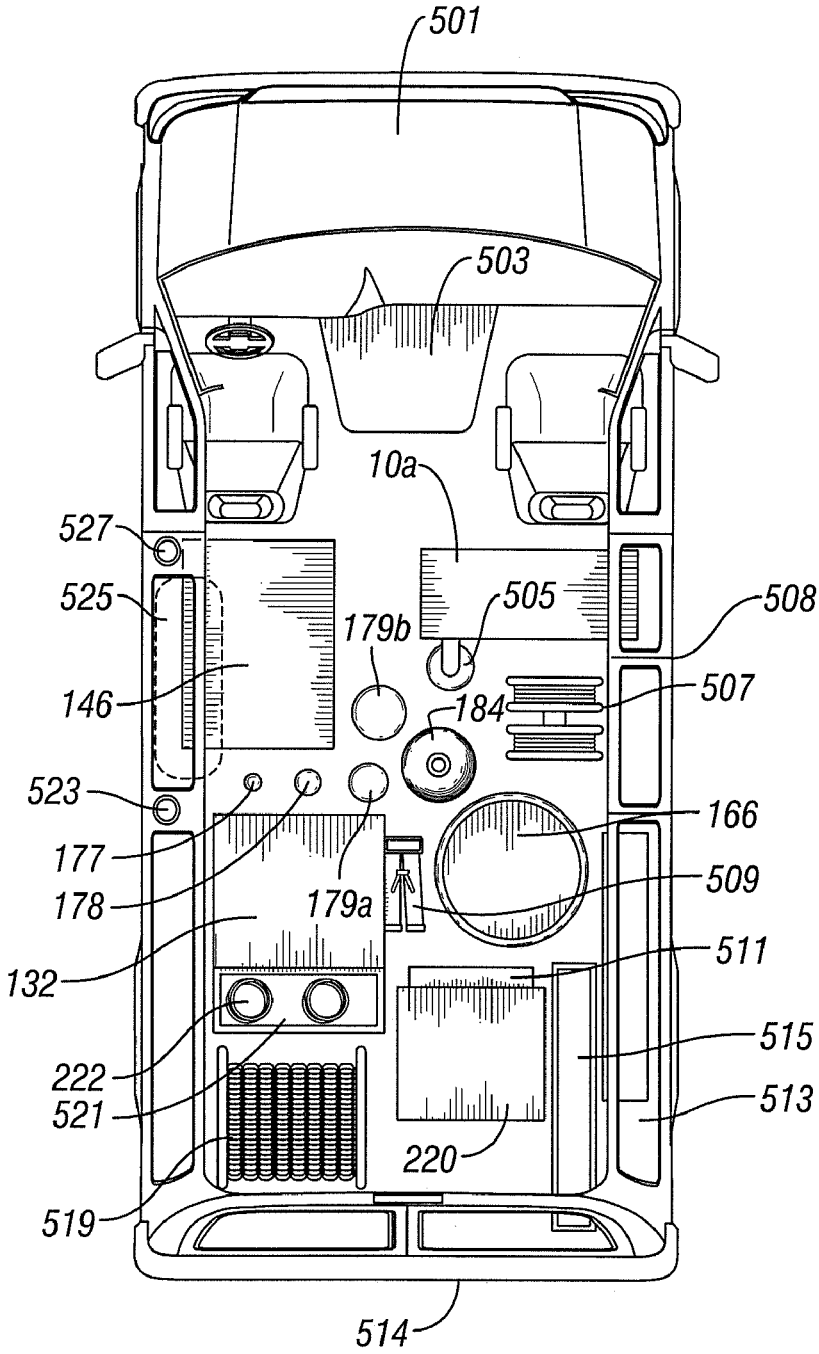
FIG. 8 is a top plan view of an extended van to illustrate a layout of the integrated cleaning apparatus according to the present invention.
Figure 10:
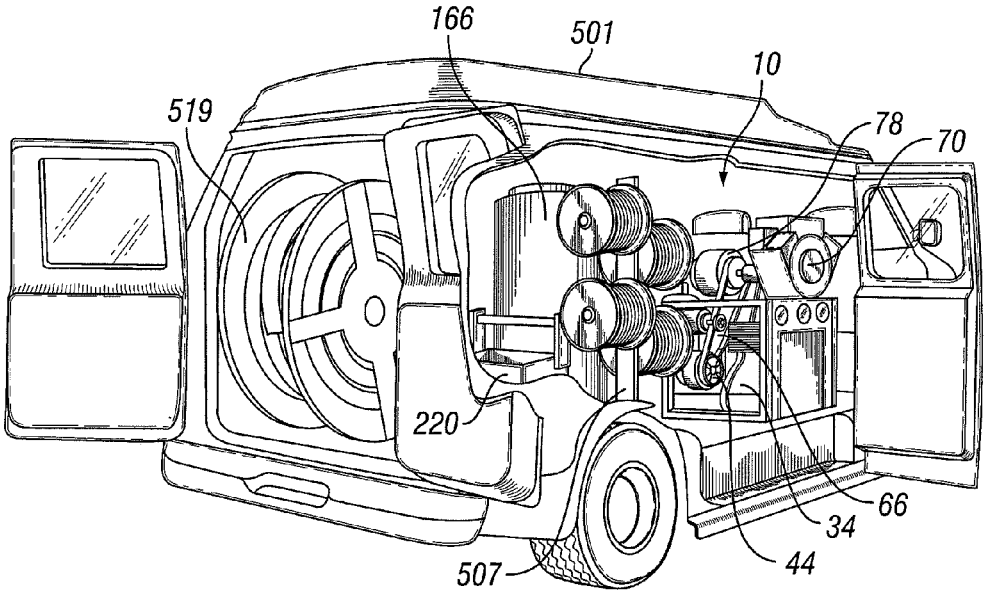
FIG. 10 is a perspective, partially cut-away view of the extended van illustrated in FIG. 8 showing a layout of the integrated cleaning apparatus according to the present invention.

Referring now in more detail to the drawings, in which like numerals indicate like parts throughout the several views, FIG. 1 illustrates a side elevation view of an integrated cleaning apparatus 10 according to the present invention for providing cleaning and maintenance services. The cleaning apparatus 10 includes a frame 12 made of horizontal members 16 and vertical members 17 defining corners of the frame. A pair of opposing top plates 20 and a pair of opposing bottom plates 32 are supported by the members 16, 17 in the frame 12. The frame 12 thereby defines a rigid structural housing for supporting the components of the integrated cleaning apparatus 10. The integrated cleaning apparatus 10 is preferably mounted within a panel truck, as illustrated in FIGS. 8 and 10. The frame 12 is permanently attached to a rectangular steel base 18. The frame 12 is preferably welded to the steel base 18. Fasteners are then used to anchor the base 18 of the integrated cleaning apparatus 10 to the floor of a panel truck. Although not illustrated, the sides of the frame can be closed, such as with baffled panels which allow for ventilation through the cleaning apparatus 10.

In the illustrated embodiment, the frame 12 has a length of 41 inches, a width of 20 inches, and a height of 25.75 inches. This includes the ¼ inch thick steel top plates 20 and the ⅛ inch thick steel base 18. The frame members 16 and 17 are preferably tubular steel having square cross sections. The top frame members 16*a* extend the length of the frame and are preferably of 2×2 inch stock. The bottom frame members 16*b* also extend the length of the frame but are preferably of 2×3 inch stock. The vertical frame members 17 span the height of the frame and are preferably of 2×2 inch stock.

An alternate embodiment (not illustrated) substitutes the steel frame with one of extruded aluminum. In this embodiment all frame members are 40 mm×80 mm in cross section and the top and bottom plates 20, 32 and the electric generator mounting plate 60 are replaced by eight horizontal frame members 20 inches long. These frame members are anchored to two 41 inch upper and two 41 inch lower vertical frame members with typical fasteners for extruded aluminum. Six aluminum "L" brackets replace the ⅛ inch steel base 18. Due to the reduced tensile strength in the 41 inch members (compared to steel) two 20⅜ inch vertical "struts" are necessary, at the midpoints of the 41 inch frame members. They are similarly fastened.

It is to be appreciated that the specific sizes, capacities, and ratings, for the framing as well as the components of the integrated cleaning apparatus 10, such as the blower, gas engine, air compressor, electric generator, water pump, and other components, are descriptive of an illustrated embodiment and are not limitations. One of ordinary skill may readily determine other suppliers of such components with differing specifications yet be suitable for practicing the integrated cleaning apparatus according to the present invention.

A pair of mounting plates 30, 32 attach to the bottom frame members 16 and the adjacent vertical frame members 17. An air compressor 34 sits on and is attached to the lower mounting plate 30. In the illustrated embodiment, bolts secure the air compressor 34 to the lower mounting plate 30. The bolts are preferably welded to the mounting plates. The air compressor in the illustrated embodiment is a GARDNER DENVER model PL15A two cylinder pressure lubricated two-stage air compressor. At 1050 (maximum) rpm the compressor delivers air to a receiving tank at a maximum rate of 23 cubic feet per minute. The air compressor 34 has a compressed air outlet for use as discussed below. A fly wheel 38 attaches to a shaft of the air compressor 34. In the illustrated embodiment, the fly wheel 38 is configured with two B section grooves for engaging a bonded double BX serrated drive belt.

A water pump 44 attaches with bolts to the lower mounting plate 32. In the illustrated embodiment, the water pump 44 is a CAT PUMPS model 51 positive displacement water pump. The pump is rated at 4.8 gallons per minute delivery at a maximum pressure of 3000 pounds per square inch. The water pump 44 has a discharge outlet for communicating water through a hose to a regulator. Another outlet communicates water to a pressure gauge. The water pump supports a twelve volt electric clutch. A high tension sprocket 48 attaches to the electric clutch for driving the shaft of the water pump 44.

In an embodiment in which the integrated cleaning device 10 is mounted within a panel truck or the like, vents through the roof communicate heat from the components of the device outwardly of the truck. The vents can include powered fans to facilitate exhausting the waste heat (not illustrated).

The pair of top plates 20 mounts to the horizontal frame members 16 in the frame 12. An intermediate mounting plate 60 mounts to a lower surface of the opposing frame members 16 in the frame 12. An electric generator 66 connects with bolts to the intermediate mounting plate 60. The electric generator 66 in the illustrated embodiment is a POWERGARD model BDB3036 revolving field, 8000 watt brushless electric generator. Nominal operating speed for the electric generator is 3600 rpm. A "close" governor 69 (see FIG. 5) on the gas engine 70 keeps the electric generator 66 operating within a narrow cycle limit (59.5 to 62.5 cycles) in order to maintain consistent output voltage. A high tension sprocket 68 with flanges for receiving a drive belt transmits horsepower to the drive shaft of the electric generator 66 as discussed below.

A gas engine 70 mounts with bolts to the top plate 20. The gas engine 70 in the illustrated embodiment is a 23 hp BRIGGS AND STRATTON VANGUARD series, "V" twin cylinder pressure lubricated gas engine operable at 3600 rpm. A drive pulley 72 connects to the drive shaft of the gas engine 70.

A high lift vacuum pump or "blower" 78 mounts with support legs 79 to the second of the top plates 20 with bolts. The bolts are preferably welded to the member of the frame 12, and pass through elongate slots in the support legs 79. The slots permit the blower 78 to be moved laterally away from the gas engine for drive belt replacement. The blower 78 in the illustrated embodiment is a ROOTS 45 twin lobe positive displacement blower in vertical configuration. The drive shaft 80 of the blower 78 coaxially aligns with the drive shaft 88 of the gas engine 70. The drive shaft 80 receives a high tension sprocket 82. The drive shaft 88 receives a double B section pulley 72. A flex coupler 86 attaches to and joins the drive shaft 80 and the drive shaft 88. Operation of the gas engine 70 causes the blower 78 to rotate. The flex coupler 86 is a direct drive D-FLEX coupling between the gas engine 70 and the blower 78. Lateral movement of the blower 78 separates the halves of the flex coupler 86 enabling the drive belts and/or flex coupler 86 to be replaced. In the illustrated embodiment, the flex coupler 86 is an EPDM type S, size 8 coupling.

An alternate embodiment (not illustrated) uses a power take-off (PTO) drive in which the gas engine 70 is replaced by a transverse axle shaft terminating distally at a pulley mounted to the engine block of the extended van 501. An endless belt connects the pulley to a drive pulley on the front main shaft of the van's automotive engine whereby power is transmitted to the various components of the integrated cleaning apparatus 10.

Figure 2:
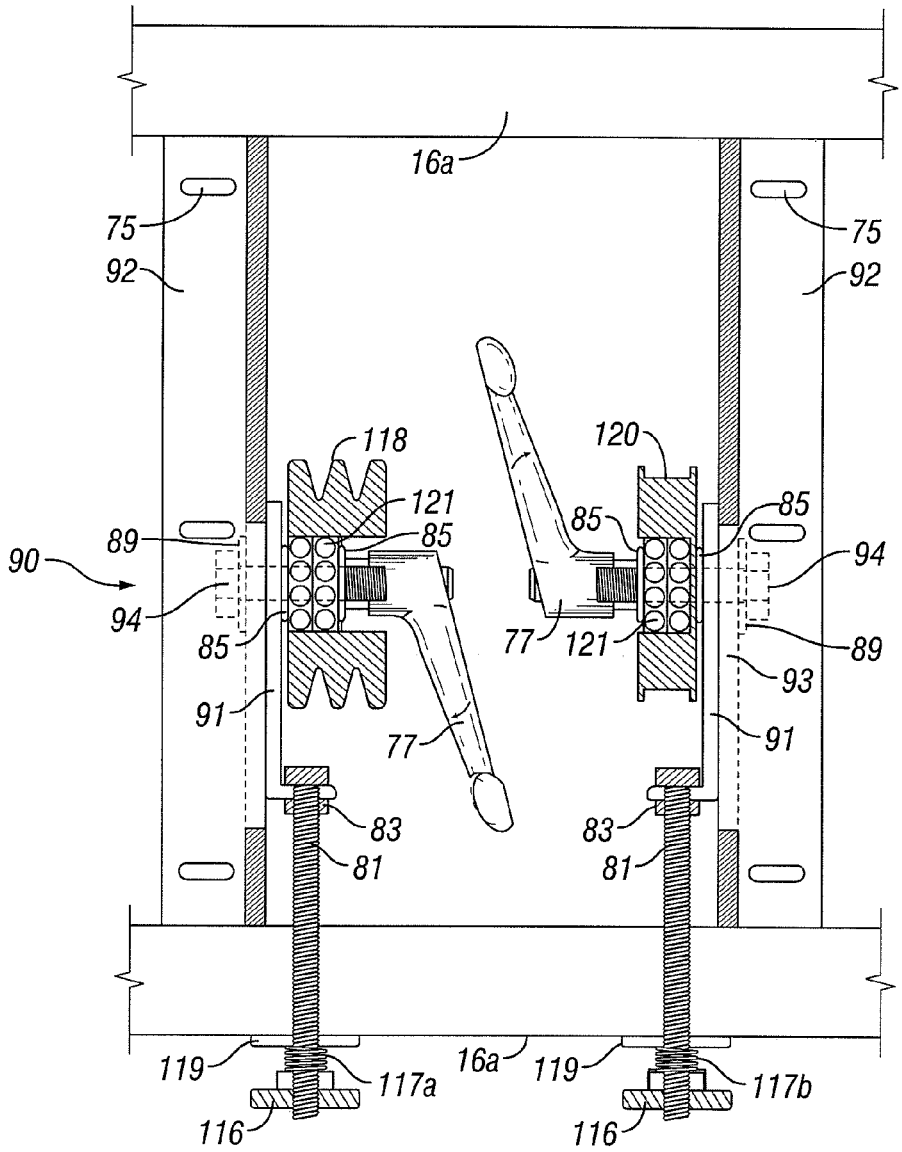
FIG. 2 is a detailed illustration of a "tool-less" belt tensioning system for the cleaning apparatus illustrated in FIG. 1.

A pair of improved belt tensioners 90 attach to the frame 12 and the top plate 20. These "tool-less" belt tensioners 90 are illustrated in top view in FIG. 2. Each tensioner includes support members 92 which are angle members that define elongate slots 93. The slots 93 receive idler shafts 94 that extend laterally through lock washers 89, the elongate slots 93, tensioning arms 91, second washers 85, bearing races 121, third washers 85, and terminate at clamping arms 77.

In an alternate embodiment (not illustrated), the idler shaft 94 includes a tab that rides in and bears against the side surfaces defined by the elongate slot 93 of the support member 92. The tab acts to stop the idler shaft 94 from rotating when loosening and tightening the belt tensioner 90, as described below.

An L-shaped tensioning arm 91 defines an opening for being received on the idler shaft 94. An idler pulley 118 having the bearing race 121 is received on the idler shaft 94, as shown in cut-away view, for free rotation relative to the idler shaft 94. The opposing belt tensioner receives an idler sprocket 120. The washer 85 is disposed between the respective idler pulley 118/idler sprocket 120 and the tensioning arm 91. The clamping arm 77 threadably engages the distal end of the idler shaft 94. The clamping arm 77 is ratchetable and operates to loosen and tighten the idler shaft 94 for adjustment.

The opposing end of the tensioning arm 91 receives a threaded tensioning bolt 81 which extends below the upper horizontal frame member 16*a* and through the tensioning bolt stop bracket 119. A nut 83 secures the tensioning bolt 81 to the tensioning arm 91. The stop bracket 119 connects to the upper horizontal frame member 16*a*. A knurled knob 116 is threaded on the distal end of the tensioning bolt 81. An indicator spring 117 is disposed intermediate the knob 116 and the stop bracket 119. The indicator spring 117*a* on the v-belt side of the drive is an 18 lb spring. The indicator spring 117*b* on the toothed belt side is a 4.5 lb spring. When the indicator springs 117*a*, 117*b* are fully compressed, the respective belts are tensioned properly.

The two separate belt tensioning devices 90 provide for independent belt tension adjustment for each drive. This is accomplished by first rotating the clamping arm 77 thereby loosening the idler shaft 91 relative to the support member 92. Second, the knurled knob 116 is rotated relative to the tensioning bolt 81. This causes the tensioning arm 91 to move longitudinally and thereby move the idler shaft 94 along the guide slot 93. Movement of the idler shaft 94 causes the respective idler pulley 119 or idler sprocket 120 to move, and thereby tightens or loosens the tension on the respective v-belt 124 or toothed belt 126 carried by the respective idler pulley 118 or idler sprocket 120. Third, upon arriving at the proper belt tension (as indicated by full compression of the spring indicators 117*a* and 117*b*), the clamping arm 77 is rotated in an opposing direction. This tightens the idler shaft 94 into engagement with the support member 92 to lock the tensioning device 90.

Figure 3:
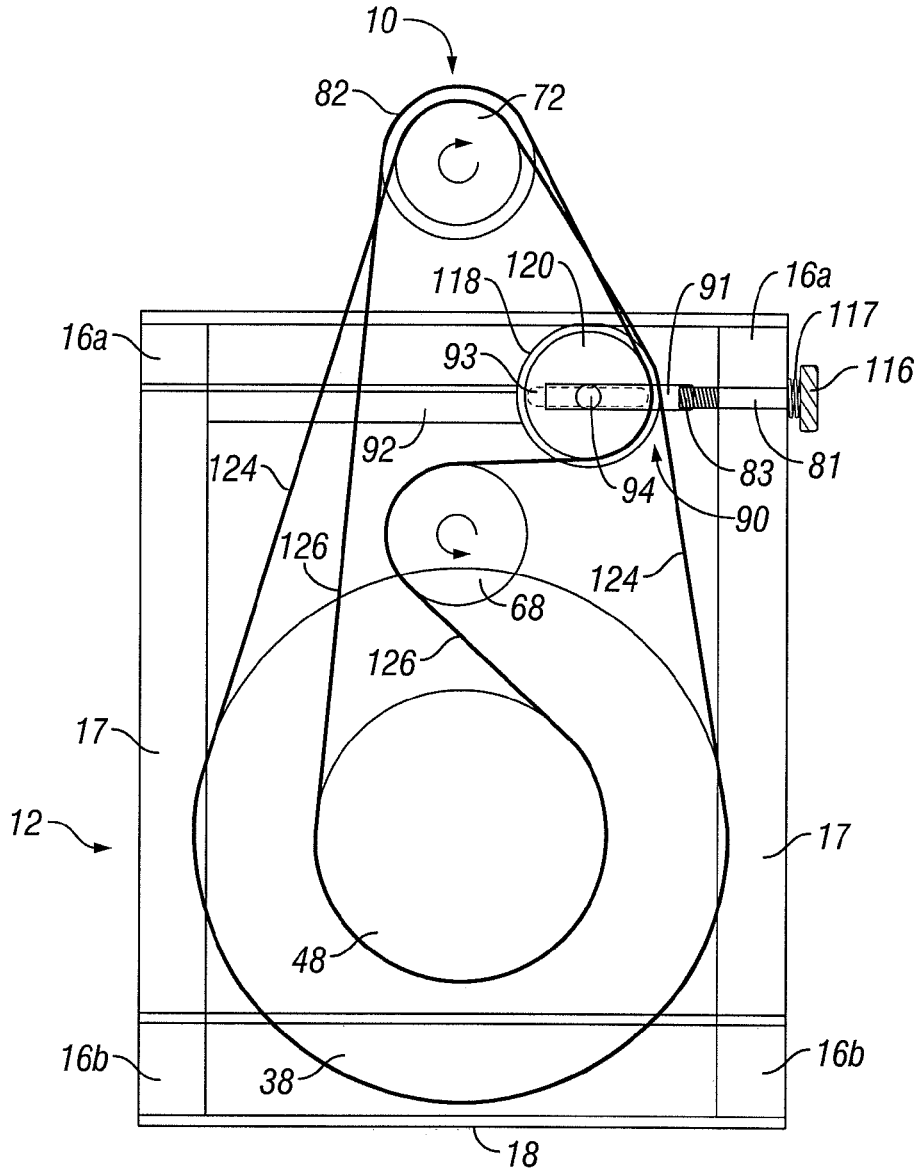
FIG. 3 is a schematic illustration of the drive belt configuration for the cleaning apparatus shown in FIG. 1.

With reference to FIG. 3, the integrated cleaning apparatus 10 provides a common drive system with a v-belt 124 and a serpentine belt 126 engaged as illustrated in schematic side view in FIG. 3. The v-belt 124 connects between the gas engine pulley 72, over the idler pulley 118, and the air compressor pulley/fly wheel 38. The serpentine belt 126 connects between the blower sprocket 82, over the idler sprocket 120, about the electric generator sprocket 68, and about the water pump sprocket/electric clutch assembly 48. Also illustrated in FIG. 3, as the v-belt 124 and the serpentine belt 126 pass over the idler pulley 118 and the idler sprocket 120 respectively, they are tensioned appropriately by the belt tensioners 90.

It is to be appreciated that the gas engine drive pulley 72, blower drive sprocket 82, air compressor driven pulley 38, electric generator driven sprocket 68 and water pump driven sprocket 48 are of appropriate diameters to cause the air compressor 34, water pump 44 and electric generator 66 to operate at speeds within their normal range. Furthermore, the blower 78 direct driven by the gas engine 70 operates at speeds within its normal range. Similarly, the idler pulley 118 and idler sprocket 120 are of appropriate diameters to operate within their normal range at their driven speeds.

Figure 4:
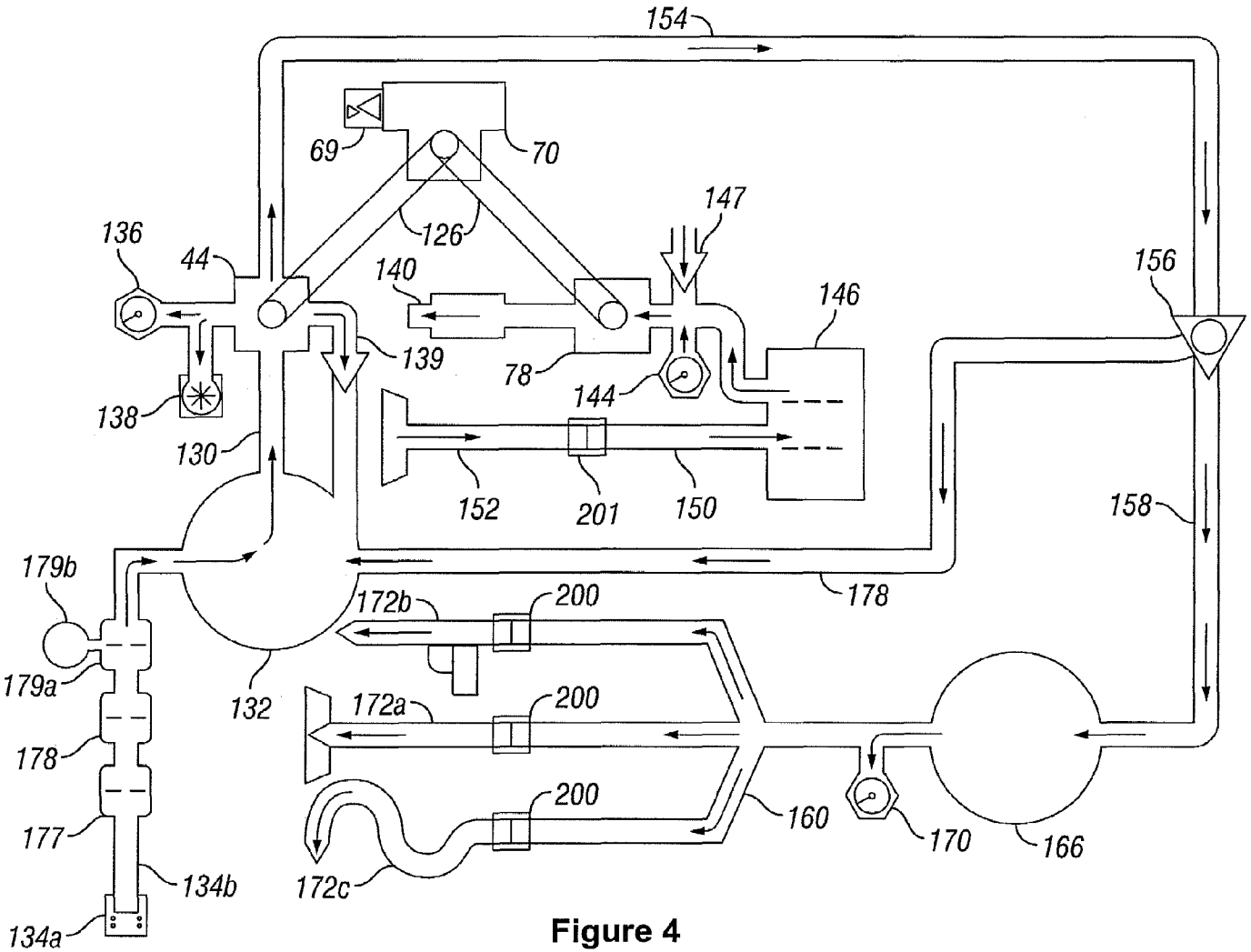
FIG. 4 is a schematic illustration of the cleaning apparatus shown in FIG. 1 in a first configuration.

FIG. 4 is a schematic illustration of the cleaning apparatus 10 shown in the first configuration for pressure washing, carpet cleaning, or drain opening. The water pump 44 communicates through a hose 130 to a fresh water supply tank 132. The fresh water tank 132 is supplied with water through a hose 134 that connects to a typical water faucet 134*a* such as a municipal water supply delivering water at a rate of 4½ to 5 gallons per minute. In the illustrated embodiment, the water communicates through a magnetic alignment water conditioner 177, an activated charcoal filter 178 and a saline-type water conditioner 179*a* that communicates with a brine tank 179*b*. These filters/conditioners 177, 178, 179*a* and 179*b* seek to neutralize the percent hydrogen (ph) of the water going into the fresh water tank 132; thereby configuring the integrated cleaning apparatus 10 for use with ph sensitive "natural" or biodegradable cleaning agents.

The water pump 44 in the illustrated embodiment includes a pressure gauge 136 scaled for 0–3500 pounds per square inch. The water pump 44 also includes a high pressure sensor with indicator light 138. These serve to caution the operator when using water at pressures over 1500 psi. Water at 1500 psi or more can easily injure an operator, helper or bystander. A relief valve 139 communicates water back to the fresh water tank 132 if the system pressure exceeds 3500 psi. This protects the water pump 44 from mechanical damage.

The positive displacement blower 78 connects to a muffler 140 for quietly exhausting the hot, pressurized air. The illustrated embodiment includes a vacuum gauge 144 connected to the vacuum side of the blower 78. A relief valve 147 also connected to the blower 78 automatically opens at 15 inches Hg vacuum to protect the blower 78 from overheating. A 70 gallon waste water tank 146 includes a baffled compartment for holding waste water from the carpet cleaning process, as discussed below. A vacuum hose 150 attaches to the waste water tank 146 and distally through a vacuum fitting 201 to the carpet cleaning wand 152 for extracting rinse water from carpets.

The water pump 44 is connected by a hose 154 to a water pressure regulator 156 which supplies water to the water heater 166. A return line 178 communicates water back to the fresh water tank 132 when the water pump 44 is operating and the pressure washing tool 172 is not actuated. The water heater 166 is a high capacity propane-fired water heater. In the illustrated embodiment, the water heater 166 is a 450,000 Btu/hr model, necessary to maintain maximum water temperature throughout the duration of a typical high pressure washing. A temperature gauge 170 connects between the water heater 166 and pressure washing tools generally 172. The washing tools 172 connect through quick connect fittings 200 to the discharge from the water heater 166. These tools include a carpet cleaning wand 172*a*, a pressure washing gun 172*b* and a "tri-jet" high pressure cleaning snake 172*c* for drain cleaning with pressurized water.

In the illustrated embodiment, the fresh water tank 132 is of 125 gallon capacity and connects by a typical faucet fitting 134*a* and water hose 134*b* to a water source, such as a municipal water system. The fresh water tank may be "baffled" to have four separate compartments that communicate water through portals. This facilitates ease of transport when the fresh water tank 132 is at full capacity. The fresh water tank 132 is sized to keep up with the demand of the water pump 44 (4.5 to 5 gpm) when configured for high pressure washing. The typical 50 gallon fresh water tank used for carpet and upholstery cleaning lacks the necessary reserve water capacity for high pressure washing, particularly in the absence of a municipal water source 134. Specifically, at a demand of 5 gpm a 50 gallon supply of water only lasts about 10 minutes.

The fresh water tank 132 can include a float valve whereby the water level in the fresh water tank 132 is maintained automatically. The fresh water tank 132 can also include a vertical "sight glass" (not pictured) generally of clear plastic tubing running the height of the fresh water tank 132 whereby the water level in the fresh water tank 132 can be viewed.

The water pump 44 communicates water through the water hose 154 at a regulated pressure as determined by the adjustment of the water pressure regulator 156. The water is heated by the water heater 166 and communicated to the water pressure tools 172. For either pressure washing or carpet cleaning, water is communicated through the pressure washing tools 172*a*, 172*b* as appropriate. For carpet cleaning, the blower 78 is operated to provide a vacuum through the waste water tank 146 so that the wand 152 drawn across the carpet can extract rinse water which communicates through the hose 150 to the waste water tank 146.

An alternate embodiment (not illustrated) uses a heat exchange system in which the water heater 166 is replaced by a three stage heat exchanger and a booster heater. The gas engine 70 is replaced by a water-cooled model of similar size. Copper coils attach in close proximity to the radiator of the substitute gas engine, the gas engine exhaust manifold and the blower 78 exhaust. The copper coils are sized to withstand water pressures up to 3500 pounds per square inch (psi). A small propane booster heater (for example, 120,000 Btu/hour) provides additional heat when needed. Water passes through the coils in the heat exchange system and through the unfired booster heater to produce hot water (160 to 190 degrees F.) for low pressure washing. The booster water heater is activated when full heat (160 to 190 degrees F.) is needed for high pressure washing at the maximum flow of five gallons per minute. At this high rate of flow (5 gpm) the heat exchange system cannot meet the demand for applied heat (exceeding 400,000 Btu/hr) without assistance from the propane booster heater.

An air pressure switch 33 (illustrated in FIG. 5) opens or closes the 12 volt circuit powering the electric clutch 48 that engages the water pump 44 to the serpentine drive. The switch 33 connects mechanically to the air circuit and pilot valve that cycle the air compressor 34 on and off for replenishing the air receiving tank 184. When the air pressure switch 33 senses a pressure drop in the air circuit, the switch causes an "open" condition in the 12 volt electric circuit which supplies power to the electric clutch 48. This in turn disengages the water pump 44 from the serpentine drive while the compressor 34 is recharging the air receiving tank 184. The importance of the air pressure switch 33 will become evident below.

In the illustrated embodiment, the components of the integrated cleaning apparatus 10 have the following average horsepower requirements: the blower 78 requires 15 hp at full lift (15 inches Hg). The water pump 44 requires 2 hp at low pressure (600 psi) and 14 hp at high pressure (3000 psi). The air compressor 34 requires 7 hp at full delivery (23 cfm). The electric generator 66 requires 18 hp to start a 5 hp electric motor and 10 hp to run that motor at (3500 watts) supplied power. The components have scant horsepower requirements when not engaged to the gas engine 70 and thus not moving air, current or water. The gas engine 70 however, provides a maximum of 22 hp according to the manufacturer BRIGGS AND STRATTON.

The air pressure switch 33 accordingly prevents the water pump 44 from being started or operated when the air compressor 34 is requiring full horsepower from the drive. Because compressed air systems leak over time, the air compressor 34 cycles (on/off) occasionally. When the air compressor 34 cycles on, the air pressure switch 33 opens the circuit to the electric clutch 48, thus disengaging the water pump 44 from the gas engine 70. The operator in the field necessarily loses water pressure at the carpet cleaning wand 152 or the pressure washing gun 172*b*. The operator then disengages the carpet cleaning wand 152 from the floor and/or waits a brief period for the air receiving tank to be replenished. The air pressure switch then closes the circuit to the electric clutch 48 and the water pump 44 begins pumping again thereby restoring water pressure to the carpet cleaning wand 152 or pressure washing gun 172*b*.

Furthermore, carpet and upholstery cleaning require the blower 78 at high lift and the water pump 44 at low pressure suggesting a horsepower requirement of 15 hp+2 hp or 17 hp. Pressure washing at ultra high pressure requires only 14 hp. Air duct cleaning requires the air compressor 44 at normal delivery and the electric generator 66 at about 45 percent output (to run the air mover 220 discussed below) suggesting a horsepower requirement of 7 hp+10 hp or 17 hp. Running air tools requires no more than 7 hp form the air compressor 44. As well, running most electric tools requires no more than 10 hp from the electric generator 66. In fact, running air and electric tools simultaneously only requires 7 hp+10 hp or 17 hp. Generally, typical configurations for the integrated cleaning apparatus 10 do not require more than 17 horsepower. This provides the gas engine 70 in the illustrated embodiment with an appropriate service factor.

Figure 5:
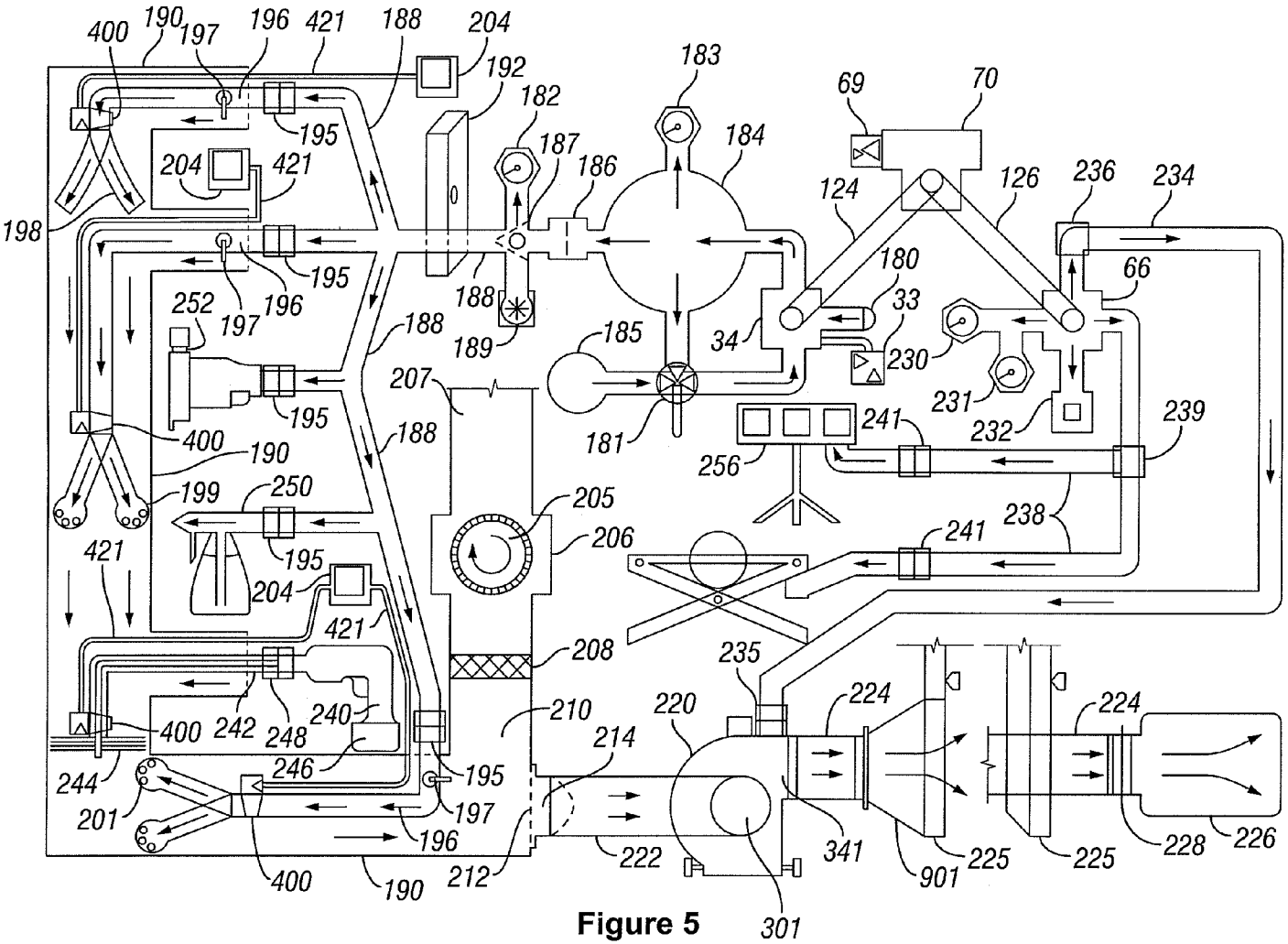
FIG. 5 is a schematic illustration of the cleaning apparatus shown in FIG. 1 in a second configuration.

FIG. 5 is a schematic view of the cleaning apparatus 10 in a second configuration for cleaning HVAC ducts 190 in a building. Also illustrated are air and electric powered tools used in repair and maintenance services. The gas engine 70 continuously drives the air compressor 34 and the electric generator 66 by the drive belts 124, 126. The air compressor 34 receives air through an inlet 180 from ambient air. In the illustrated embodiment, the inlet 180 includes a filter. An air pressure gauge 182 connects to the air filter/regulator 187. An air receiving tank 184 with an air tank pressure gauge 183 is charged by the air compressor 34. A panel mounted red indicator light 189 ceases to illuminate whenever the air compressor 34 cycles off. In the illustrated embodiment, the 30 gallon air receiving tank 184 fluctuates between 165 and 195 psi as it is charged by the air compressor 34 at a rate of 23 cfm.

An alternate embodiment uses an automatic compressor disengagement device (ACD) to control recycling of the air compressor 34. A small auxiliary air tank 185 connects through a gate valve 181 to provide compressed air at 250 pounds per square inch to the mechanical air circuit that controls the cycling of the air compressor 34. When the gate valve 181 is opened, compressed air at sufficient pressure (195 psi or more) engages the pilot valve of the air compressor 34. The pilot valve is thereby configured for holding the finger valves of the air compressor 34 open. The air compressor 34 will not pump (or use horsepower) in this state which duplicates pilot valve function when the air receiving tank 184 is at full pressure (195 psi). When the gate valve 181 is closed, the pilot valve is disengaged and the air compressor 34 returns to normal operation, cycling on when the air receiving tank 184 falls below 165 psi and off when the air receiving tank 184 again reaches 195 psi.

The outlet of the air receiving tank 184 communicates through a compressed air dryer module 186 to an air filter/regulator 187. The filter/regulator 187 adjusts the pressure of the air leaving the air receiving tank 184 from 0 to 250 psi for different uses. A suitable length of air hose 188 connects to the air filter/regulator 187 and distally through a quick connect fitting 195 to the air rod system 196 and video air tool 400 used for air duct cleaning. Other air tools such as the staple gun 252 and paint sprayer 250 can be similarly attached. It is in this manner that compressed air is brought from the integrated cleaning apparatus 10 into a building for use as discussed below.

The integrated cleaning apparatus 10 of the present invention is preferably installed in a panel truck for use at various homes and offices for cleaning and maintenance purposes. In the illustrated configuration for the cleaning of air ducts 190, the flexible air hose 188 extends through a doorway (schematically shown as 192). The flexible air hose 188 detachably connects to the distal end of an air rod system 196. The air rod system 196 consists of interlocking sections of nylon tubing (typically five-foot sections). This semi-rigid tubing communicates compressed air from the flexible air hose 188 to the video air tool 400. More so, the air rod system 196 helps to insert and guide the air tool 400 and pressure attachments the air whip 198, the forward skipper ball 199 and reverse skipper ball 201 as they perform air duct cleaning functions. The air whip 198 detachably connects to the distal end of the video air tool 400. The air whip 198 is constructed of small diameter flexible rubber tubing. Pressurized air from the receiving tank 184 is communicated by the flexible air hose 188 and the air rod system 196 to the video air tool 400 and the air whip 198. This causes the air whip 198 to move erratically within the confines of the air duct 190 for cleaning purposes, as discussed below. The connector (not pictured) attaching the air whip 198 to the video air tool 400 can include apertures for communicating pressurized air towards the interior walls of the air ducts 190. These apertures can be forward or rearward facing, to assist the removal of dust and debris by the air whip 198.

The video air tool 400 attaches to the distal end of the air rod system 196, and connects by a cable 202 to an 8 millimeter miniature video cassette recorder with an integral 4 inch color monitor 204. The combination VCR and color monitor 204 is powered by a rechargeable battery, and is worn around the waist as a "belly" pack. In an alternate embodiment (not illustrated) a pair of video monitor "glasses" is worn on the head bypassing the 4 inch color monitor 204 allowing the operator to better manipulate the video air tool 400 with the air rods 196. The video air tool 400 preferably embodies a tiny color video camera and a plurality of LED "headlights" for capturing images of the air ducts 190 as they are cleaned.

The video air tool 400 is navigated through the common flex or metal duct work 190 in a typical HVAC system. This includes the return air ducts 190 which connect to a return air plenum 210: The return air plenum 210 communicates air from the return air ducts 190 to the central air handler 206. The air handler 206 typically includes a blower 205 and an air filter 208, as well as a set of evaporator coils and a heat exchanger (not illustrated). The air filter 208 can also be located in the return air plenum 210 adjacent the air handler.

A circular opening 212 is cut in the air return plenum 210. A first stage safety filter 214 mounts to the opening 212. The first stage safety filter 214 in the illustrated embodiment is a stainless steel wire mesh basket having one half inch apertures, for capturing macro debris such as small toys, rocks, sheet metal screws, and other debris often present in HVAC systems. An air mover 220 connects through a flexible hose 222 to the return air plenum 210 generally close to the central air handler. In an alternate embodiment (not illustrated) the first stage filter 214 is permanently mounted at the inlet of the air mover 220. The air mover 220 pulls air from the plenum 206 during the duct cleaning process, as discussed below. The discharge of the air mover 220 connects to an elongate exhaust hose 224 that communicates the high velocity discharge air out of the building (illustrated schematically by the doorway 225). The exhaust hose 224 in the illustrated embodiment is of a common flexible type 10 inches in diameter.

FIG. 5 illustrates alternate structures for discharge of the exhaust air. In one embodiment, the exhaust hose 224 connects to an exhaust diffuser 901 (discussed further below in reference to FIGS. 9A, 9B and 9C). The exhaust diffuser 901 secures to a doorway 225. The exhaust diffuser 901 includes a round inlet that couples to the exhaust hose 224. The diffuser 901 has a tapering transition to a rectangular outlet. The doorway 225 is sealed by a door "boot" (not illustrated). The door boot is of a foam-rubber material that prevents exhausted dust and debris from re-entering the building during the cleaning process. The area adjacent the doorway 225 may require pressure washing when the evacuation of debris is complete. The exhaust diffuser 901 in conjunction with a door boot is particularly useful in inclement weather. It is to be appreciated that the exhaust diffuser 901 similiarly attaches to a window opening, for example, if the air handler is located remote from a door such as being situated in an attic space.

In a second embodiment, an air-permeable collection bag 226 connects though a double male coupler 228 to the exhaust hose 224. Preferably, the air-permeable collection bag 226 is of a fabric non-restrictive to air flow but capable of capturing the dust and debris evacuated by the air mover 220. The air-permeable collection bag 226 necessarily remains outside the building being cleaned as it is generally no more than 70 percent efficient as a filter. The air-permeable collection bag 226 is particularly useful in servicing older buildings or otherwise heavily contaminated air ducts.

The electric generator 66 is driven by the gas engine 70. Power transfers by the serpentine belt 126. The output of the electric generator in the illustrated embodiment provides 67 amps at 120 volts or 34 amps at 240 volts. An amp meter 230 and volt meter 231 monitor the output of the electric generator 66. The integrated cleaning device 10 includes two panel mounted electrical outlets 236 and 239 for directly powering various tools and a panel mounted battery charger 232 for recharging battery powered hand tools. The high voltage outlet 236 provides a single phase 240 volt service for operating the air mover 220 for duct cleaning and moisture abatement. This high voltage service can also be used to run-welding equipment or large electric tools (not illustrated). The low voltage "dual" outlet 239 provides single phase 120 volt service used for operating emergency lighting 256 or small-to-medium sized electric tools such as a table saw 254. The low voltage outlet 239, the high voltage outlet 236 and the battery charger are directly wired to the generator 66.

A suitable length of electrical cord 234 connects to the high voltage outlet 236 of the integrated cleaning apparatus 10 and distally to a panel mounted power receptacle 235 on the air mover 220. In this manner the electric generator 66 supplies power to the variable frequency drive 307 (VFD 307) housed within the motor enclosure of the air mover 220. The VFD 307 controls motor speed and resultant air flow through the air mover 220, as discussed below with respect to FIGS. 9A, 9B, and 9C. The air mover 220 includes a fan, such as a backward curved centrifugal air foil type, capable of moving air at between 4000 and 5000 cfm through a nominal static pressure range of one to three inches. Because the air mover 220 has no integral filters to "load" with dust and debris, it will generally operate at full capacity. However, on occasion it will be necessary to filter the discharge from the air mover 220 as with an air-permeable collection bag 226. This will create a nominal pressure drop at the air-permeable collection bag 226 and a slight reduction in fan efficiency. The air mover 220 will continue to operate within the 4000 to 5000 cfm range in any configuration.

The air mover 220 is powered by a 5 hp BALDOR premium efficiency three phase electric motor. The variable frequency drive 307 is useful in that it converts the single phase voltage supplied by the electric generator 66 into the three phase voltage required to power the air mover 220.

The cordless electric drill 240 connects through a flexible sheathed cable 242 to a rotary brush 244. The drill 240 also connects to a timing module 246. In the illustrated embodiment the timing module 246 is housed within the rechargeable direct current (DC) power pack normally associated with the cordless drill 240. The timing module 246 is a digital device with an analog input and output, built from commonly available components. The timing module 246 improves rotary brushing by enabling the operator to program the rotary brush 244 to change direction of rotation from clockwise to counterclockwise automatically during operation. This can also extend the life of the rotary brush 244 and the sheathed cable 242. As well, the duration of the rotation can be set and the dwell or "speed of change" between opposite rotations. The brush control afforded by the timing module 246 can be used effectively in heavily soiled air ducts. In an alternate embodiment, the electric drill 240 is corded, for use with a 120 volt power supply without the advantages of the timing module 246.

Figure 6A:
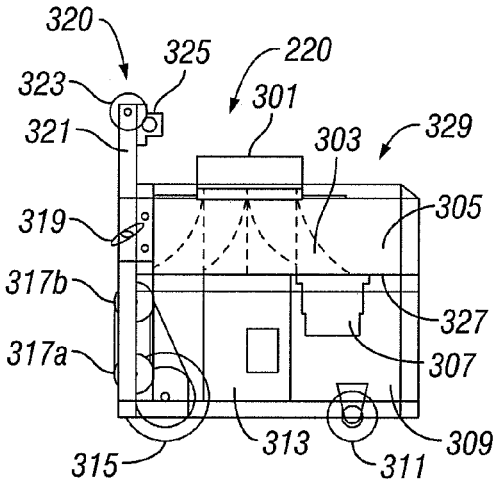
FIG. 6A is a side cut-away view of an air mover with integral dolly for use in air duct cleaning and moisture abatement.

FIG. 6A is a side cut-away view of an air mover 220 with an integral dolly 320. The air mover 220 provides vacuum for air duct cleaning and blown air or vacuum for moisture abatement. The integral dolly 320 defines a rectangular cabinet 329 for housing and transporting the air mover 220. The rectangular cabinet 329 comprises opposing upper and lower horizontal frame members 331 (FIG. 6B) interconnected by vertical frame members 351 (FIG. 6C). In the illustrated embodiment, these frame members 331 and 351 are constructed of extruded aluminum preferably 40 mm×40 mm in cross-section. Furthermore, the extruded aluminum is of a "light" designation so as to minimize the weight of the rectangular cabinet 329. The sides of the rectangular cabinet 329 are closed with ALUCABOND sheeting, a plastic substrate covered by thin sheets of aluminum (not illustrated).

The centrifugal impeller 303 having backward curved airfoil type veins mounts within an air volute 305 in an upper portion of the rectangular cabinet 329. The air volute 305 is constructed of ⅛ inch flat aluminum stock. The rectangular cabinet 329 contains a ten inch round air inlet 301 that opens upwardly. The round air inlet 301 with flange 337 is constructed of 3/16 inch flat aluminum stock. A two foot square ½ inch thick aluminum mounting plate 327 intermediate the lower and upper part of the rectangular cabinet 329 supports the 5 hp electric motor 313. The 5 hp electric motor 313 connects with the centrifugal impeller 303 causing it to rotate. The lower portion of the rectangular cabinet 329 includes sidings of ALUCABOND sheeting to define a motor enclosure 309. The 5 hp electric motor 307 connects to the variable frequency drive 307. The variable frequency drive 307 communicates with the on/off switch 353 and the motor speed potentiometer 355 mounted to a front panel of the rectangular cabinet 329. The air mover 220 with integral dolly 320 and rectangular cabinet 329 is supported by recessed front wheels 311 mounted on 3600 casters as well as recessed rear wheels 315 with ten inch pneumatic tires mounted on a 7/16 inch rolled steel axle (not illustrated).

The air mover 220 with integral dolly 320 further includes a pair of extensible rails 321 interconnected by T-handle bearing brakes 319. The extensible rails 321 "telescope" relative to the bearing brakes 319. In the illustrated embodiment the extensible rails 321 are constructed of extruded aluminum 40 mm×40 mm in cross section. Opposing pairs of stair climbing wheels 317 mount to parallel axles in vertically spaced relation. The stair climbing wheels connect together by a looping belt to facilitate transporting the air mover 220 with integral dolly 320 up or down stairs. A pair of three inch wheels 323 mounts at the distal end of the extensible rails 321. The three inch wheels 323 assist an operator in loading and unloading the air mover 220 with integral dolly 320. The extensible rails 321 act as a fulcrum when placed against the rear loading area of a typical panel truck. Two bottom handles 357 and 358 (FIGS. 6B and 6C) transversely mount between two lower frame members of the air mover 220 with integral dolly 320 permitting it to be easily lifted into or out of a panel truck. Also, a round tube handle 325 extends between the opposing extensible rails 321 for gripping and thereby pulling the air mover 220 with integral dolly 320 along.

Figure 6B:
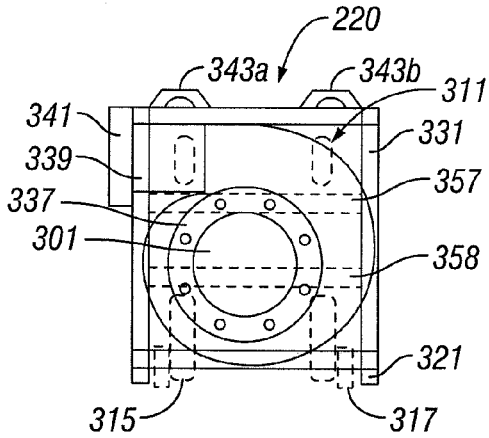
FIG. 6B is a top plan view of the air mover with integral dolly illustrated in FIG. 6A.
Figure 6C:
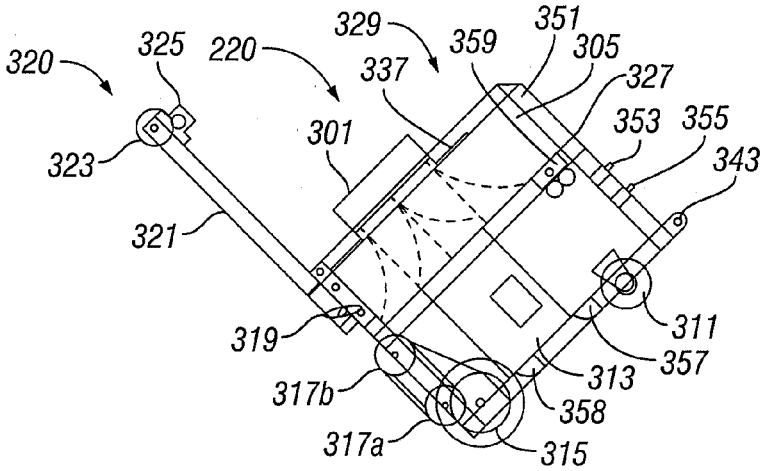
FIG. 6C is side plan view of the air mover with integral dolly illustrated in FIGS. 6A and 6B configured for stair climbing.

FIG. 6B is a top view of the air mover 220 with integral dolly 320 illustrated in FIG. 6A. The round air inlet 301 with a flange 337 connects to the top of the fan enclosure 305. A square to round transition 339 mounted to the ½ inch thick aluminum mounting plate 327 connects between the air volute 305 and a round exhaust air outlet 341. In the illustrated embodiment the round air inlet 301, the flange 337 the air volute 305, the square to round transition 339 and the round exhaust air outlet 341 are constructed of various thicknesses of flat aluminum stock to minimize the weight of air mover 220 with integral dolly 320. In the illustrated embodiment the air mover 220 with integral dolly 320 weighs only 165 pounds and requires less than ten cubic feet of storage space on a panel truck. The compactness of the air mover 220 with integral dolly 320 solves a critical storage problem for the integrated cleaning apparatus 10.

Four inch caster mounted front wheels 311 and ten inch rear wheels 315 and stair climbers 317 are illustrated respectively. Handles 343*a* and 343*b* mount to a lower frame member and provide grips for loading and unloading the air mover 220 with integral dolly 320 or navigating stairways. As mentioned, transversely mounted handles 357 and 358 on the bottom of the rectangular cabinet 329 enable an operator to load or unload the air mover 220 with integral dolly 320 unassisted.

Motor starting and speed are controlled digitally by a variable frequency drive 307 (FIG. 6A). The variable frequency drive 307 interprets an analogue signal from an on/off switch 353 and a motor speed potentiometer 355 located on a front panel of the air mover 220 with integral dolly 320 (FIG. 6C). When the on/off switch 353 is activated the 5 hp electric motor 313 starts and "ramps" to the speed indicated by the motor speed potentiometer 355.

The final speed and resultant airflow through the air mover 220 with integral dolly 320 are controlled by adjustment of the motor speed potentiometer 355. The variable frequency drive 307 is powered by the electric generator 66 or by another suitable 240 volt power source. Overload protection is provided by a pair of 25 amp slow blow fuses 359 mounted within the motor enclosure 309 (FIG. 6C). A panel mounted 240 volt power receptacle (not illustrated) also mounts on the front panel of the air mover 220 with integral dolly 320.

FIG. 6C is a side view of the air mover 220 with integral dolly 320 illustrated in FIGS. 6A and 6B configured for stair climbing. The extensible rails 321 is are fully extended with respect to the T-handle bearing brakes 319. The 5 hp electric motor 313 (in this configuration) is located at the center of gravity of the air mover 220 with integral dolly 320. Subsequently, no "moment" exists about the axis defined by the 10 inch rear wheels 315 contacting the floor. The air mover 220 with integral dolly 320 and rectangular cabinet 329 moves easily and safely up or down stairs. The 25 amp fuse block 359 is pictured here, as well as the on/off switch 353 and the motor speed potentiometer 355.

Figure 7A:
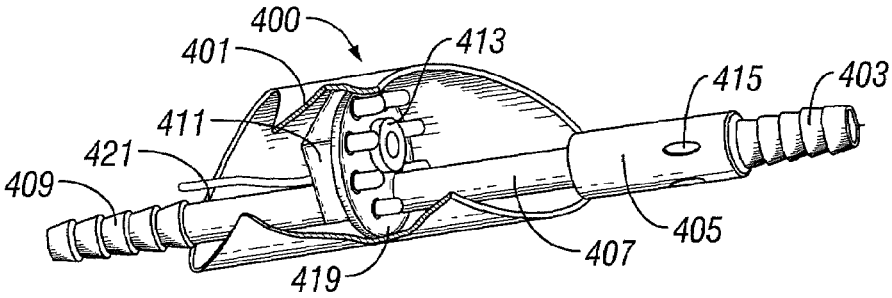
FIG. 7A is a perspective, partially-cut-away view of a video air tool that supports a video camera and lighting array within an enclosure while connecting at opposing distal ends to an air washer and a supply of compressed air.

FIG. 7A is a perspective, partially-cut-away view of a video air tool 400 that supports a camera 411 within a camera enclosure 401 and an air extension tube 407 that connects at a distal end to an air washer 405. The air washer 405 defines a plurality of air ports 415 which in the illustrated embodiment are angled forwardly in order to distribute air in a forward direction. The air communicated through the ports 415 assists the video air tool 400 in dislodging dust and debris for evacuation by the air mover 220 (not illustrated). In an alternate embodiment the air washer 405 can have a plurality of air ports angled to the rear or without ports, serving only to connect the video air tool 400 to a pressure attachment; for example a hose barb 403 at a distal end of the air washer 405 receives attachable air whips 198, forward skipper balls 199 and reverse skipper balls 201 for dislodging dust and debris.

An opposing distal end of the air extension tube 407 defines a hose barb 409 that connects to an air rod system 196. The air rods 196 are elongate members communicating air under pressure for duct cleaning purposes. Furthermore, the air rods 196 allow the video air tool 400 and its pressure attachments the air whip 198, forward skipper ball 199 and reverse skipper ball 201 to be inserted and moved longitudinally within the air ducts 190.

In the illustrated embodiment all metal parts of the video air tool 400, namely the camera enclosure 401, the air washer 405 with hose barb 403, and the air extension tube 407 with hose barb 409 are fabricated or machined from aluminum stock of various thicknesses, corresponding to the application of the part. Minimum size and weight defines the functionality of the video air tool 400.

A circuit board 419 mounts within the camera enclosure 401. The circuit board defines a notch in a lower portion for passage of the air extension tube 407 through the camera enclosure 401. A 0.625 inch square×0.375 inch deep CMOS color video camera 411 mounts to the circuit board 419. A 3 mm wide angle lens 413 faces forwardly from the housing 411. A plurality of light emitting diodes is disposed in an arc around the lens body 413 to illuminate the duct forwardly of the cleaning device. A cable 421 communicates power to the video camera 411 and the LEDs 427 (FIG. 7*c*) as well as communicating video signals from the camera 411 to a monitor and recording device (not illustrated). The camera enclosure 401 in the illustrated embodiment is one inch (outside diameter), which conforms to a common auger size for drilling into HVAC systems for insertion of air whips 198, forward skipper balls 199 and reverse skipper balls 201 which detachably connect to the video air tool 400.

Figure 7B:
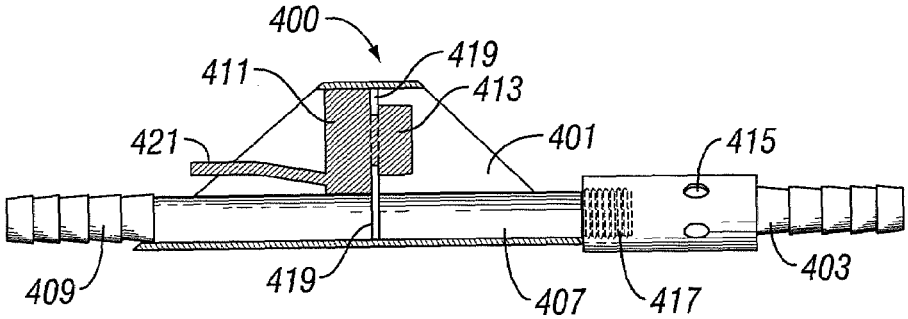
FIG. 7B is a side plan view of the video air tool illustrated FIG. 7A.

FIG. 7B is a side plan view of the video air tool 400 illustrated FIG. 7A. A very small self contained color video camera 411 is housed precisely within the camera enclosure 401. The camera enclosure 401 also houses an air extension tube 407 positioned directly below the video camera 411. The video camera 411 and air extension tube 407 together define a minimum inside diameter of 0.902 inches for the camera enclosure 401. A subsequent wall thickness of 0.048 inches is sufficient to house the assembly. An outside diameter of one inch allows for easy insertion of the video air tool 400 and pressure attachments the air whip 198, forward skipper ball 199 and reverse skipper ball 201 into any aspect of the HVAC system through either pre-drilled holes or the normal air duct openings.

Figure 7C:
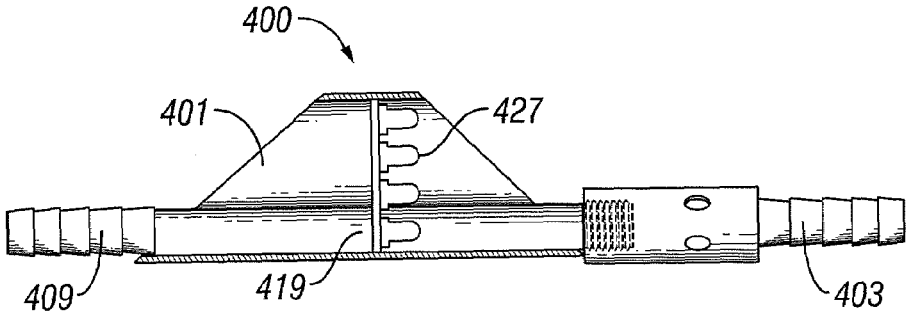
FIG. 7C is another side plan view of the video air tool illustrated FIG. 7A.

FIG. 7C is a side plan view of the video air tool 400 illustrated in FIGS. 7A and 7B. A plurality of bright white LEDs 427 disposed in an arc on a circuit board 419 defines a lighting array for the video camera 411 in FIG. 7*b*. These are 30 degree LEDs 427 dispersing emitted light in a pattern 15 degrees above and below centerline. In the illustrated embodiment there are eight LEDs 427 forward facing and spaced apart equally. In an alternate embodiment (not pictured) there could be as many as sixteen LEDs of various dispersion angles between 15 and 60 degrees.

FIG. 8 is a top plan view of an extended van 501 to illustrate a layout of the integrated cleaning apparatus according to the present invention. A front cargo hold mounts between the front seats. The cargo hold 503 contains tools, a food cooler, invoices, and other equipment related to the use of the integrated cleaning apparatus 10. The integrated cleaning apparatus 10 mounts behind a passenger seat with a control panel facing outwardly and accessible through the doors of the extended van 501. An exhaust muffler 505 mounts to the floor of the extended van 501 and connects to the blower 78 and the gas engine 70 supported by the frame of the integrated cleaning apparatus 10. The exhaust muffler 505 vents preferably through the floor of the extended van 501. The 30 gallon air receiver tank 184 mounts adjacent the exhaust muffler 505 and inward from the side doors of the extended van 501.

A service hose tree 507 mounts adjacent the side entrance of the extended van 501 outwardly of the water heater 166. The service hose tree 507 provides four separate hose reels with hoses. The water hose 134*b* (not illustrated) connects at a distal end to the fresh water tank 132 with an opposing free end for connecting to a supply of fresh water. The high pressure water hose 154 (not illustrated) connects to the water heater 166 for high and low pressure washing. The air hose 188 (not illustrated) connects to the air receiving tank 184 for powering the video air tool 400 (not illustrated) and common air tools such as the air staple gun 252 (not illustrated). The fourth reel contains is a 12 gauge electric drop cord (not illustrated) for powering the air mover 220 and electric tools such as the table saw 254 (not illustrated) from the integrated cleaning apparatus 10.

A 15-foot foldable combination step/extension ladder 509 mounts to a support inwardly of the extended van 501 accessible through the rear doors 514. The water heater 166 sits in an aft space next to aft storage 513 for air whips, skipper balls and rods. The frame 511 supports the air mover 220 for air duct cleaning and moisture abatement described above in reference to FIGS. 6A, 6B and 6C. The air mover 220 is accessible through the rear doors 514. Additional aft storage 515 is available for cleaning agents and the like. The vacuum hose reel 519 for carpet cleaning is mounted to the back portion of the extended van 501 and is accessible through the rear doors 514. Two collapsible sections of 10 inch diameter flexible vacuum hose 222 for air duct cleaning are stowed in a hose compartment 521 inwardly of the vacuum hose reel 519 for carpet cleaning. The hose compartment 521 mounts adjacent the 125 gallon fresh water tank 132. The saline type water conditioner 179*a*, the activated charcoal filter 178, and the magnetic alignment water conditioner 177 mount next to the fresh water tank 132. The brine tank 179*b* sits adjacent the waste water tank 146 behind the driver seat of the extended van 501. The 12 gallon propane tank 525 mounts beneath the extended van 501 for providing fuel to operate the water heater 166. A purge valve 527 communicates waste water from the waste water tank 146 to an appropriate dump site. Similarly, a second purge valve 523 communicates unused water from the fresh water tank 132 to an appropriate dumpsite. The purge valves 523 and 527 facilitate operation of the extended van 501 without extraneous payload. The float valve 146 communicates with an automatic sump pump within the waste water tank 146 (not illustrated). This sump pump can be placed in automatic mode for use in flood damage jobs where water extraction operates non-stop for many hours.

The illustrated layout facilitates storage of various air and electric tools, air whips, skipper balls, air rods and the like for cleaning and maintenance work. The integrated cleaning apparatus 10 is readily accessible from the side doorway of the extended van 501 with the control panel facing outwardly. The air mover 220 is readily accessible—through the rear doorway of the extended van 501. There is an additional cargo space at the rear of the extended van 501 between the air mover 220 and the rear doors 514 for use as needed.

Figure 9A:
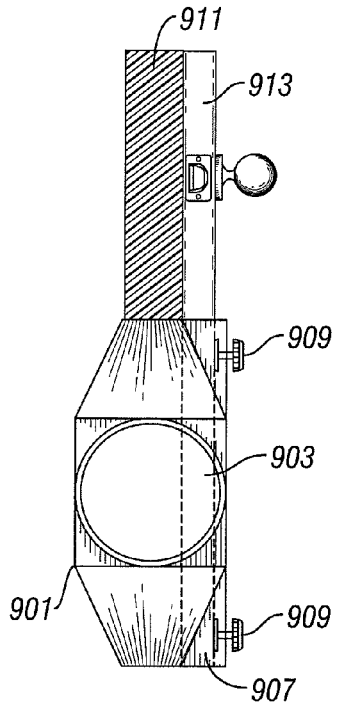
FIGS. 9A, 9B and 9C are side, top and front plan views of an exhaust diffuser that facilitates the expulsion of dust and debris during an air duct cleaning while isolating the interior of a building from heat, cold and debris.

FIG. 9A is a front plan view of an exhaust diffuser 901 used in air duct cleaning. It comprises a round air inlet 903 and a rectangular exhaust air outlet 905. A door bracket 907 is permanently attached to the rectangular exhaust air outlet 905. A pair of clamps threadably extends through the door bracket 907 to secure the exhaust diffuser 901 to an edge of the door 913. A door boot 911 takes up the space between the door 913 and the door jam (not pictured) so as to insulate the building interior from exhausted debris and outside weather conditions.

Figure 9B:
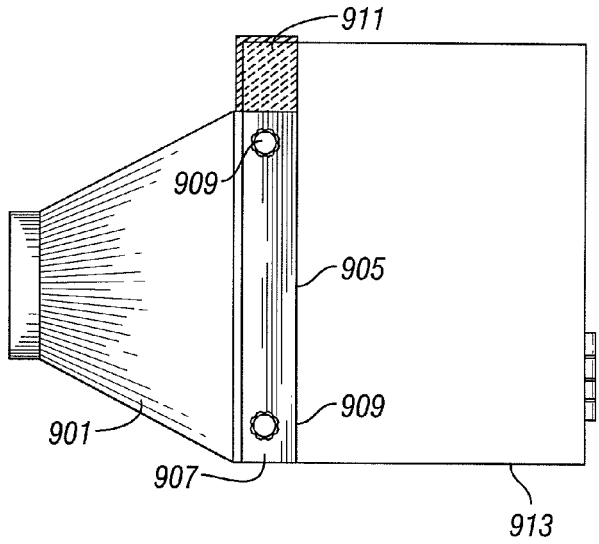

FIG. 9B is a side plan view of the exhaust diffuser 901 illustrated in FIG. 9A. The transition between the round air inlet 903 and rectangular exhaust air outlet 905 is evident. The cross-sectional area of the round air inlet 903 is equal to the cross-sectional area of the rectangular exhaust air outlet 905. Subsequently, the pressure drop through the transition is minimal. Two threadable adjusting clamps 909 secure the exhaust diffuser 901 to the door 913.

Figure 9C:
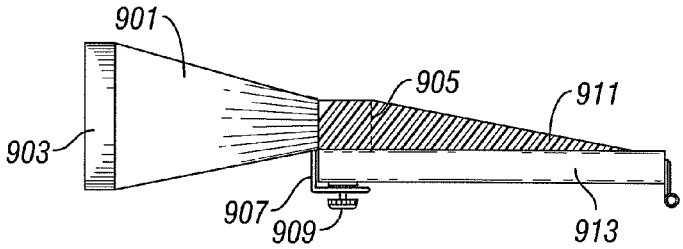

FIG. 9C is a top plan view of the exhaust diffuser 901 illustrated in FIGS. 9A and 9B. Of particular interest is is the horizontal section of the door boot 911 shown here to particularly conform to the triangular opening between the door jam (not pictured) and the door 913. The relationship between the threadable adjusting clamps 909 and the door bracket 907 is clear. Also, the tapered transition from the ten inch wide round air inlet 903 to the three inch wide rectangular exhaust air outlet 905 is illustrated.

This tapered transition defines a practical width of three inches for the door boot 911.

FIG. 10 is a perspective, partially-cut-away view of the extended van 501 that houses and transports the integrated cleaning apparatus 10. Because the components illustrated in FIG. 10 also appear in FIG. 8 (and others) they will only be briefly listed here: the vacuum hose reel 519 for carpet cleaning; the water heater 166 for carpet cleaning and pressure washing; the gas engine 70 for powering the integrated cleaning apparatus 10; the vacuum "blower" 78 for carpet cleaning and extraction; the electric generator 66 for powering the air mover 220 as discussed below and various electric tools for other services; the air compressor 34 for powering the video air tool for air duct-cleaning and various air-tools for other services; the water pump 44 for carpet cleaning and pressure washing; the air mover 220 for air duct cleaning and moisture abatement; the service hose tree 507 for dispensing the water, electric and air for the various services performed by the integrated cleaning apparatus 10.

With reference to FIG. 4, the integrated cleaning apparatus 10 is used for "low pressure" washing (carpets, upholstery, draperies) and "high pressure" washing (building exteriors, marble, tile, even drain cleaning) and the like. To perform low pressure washing with extraction, the integrated cleaning apparatus 10 is activated to power the water pump 44 and the blower 78. Once the air compressor 34 has cycled off, the electric clutch 48 on the water pump 44 can be activated. Once the electric clutch 48 is activated, the water pump 44 begins pumping water through the water hose 154 to the water pressure regulator 156. The water pressure regulator 156 is adjusted to facilitate an appropriate water pressure (300 to 600 pounds per square inch) for low pressure washing as displayed on the water pressure gauge 136. Water at the selected pressure communicates from the water hose 158 to the water heater 166. The water heater 166 heats the water to cleaning temperature (160 to 190 degrees F.). The temperature of the water is monitored by the water temperature gauge 170 as it communicates from the water hose 160 to the carpet cleaning wand 172*a*. The carpet cleaning wand 172*a* is attached to the water hose 160 by a quick connect fitting 200. When a trigger on the carpet cleaning wand 172*a* is depressed (not illustrated) hot water at the selected pressure is delivered to the carpet as a sprayable rinse.

The vacuum "blower" 78 communicates vacuum to the waste water tank 146. In the illustrated embodiment, the vacuum is maintained at 15 inches Hg by a vacuum relief "pop" valve 147. The vacuum hose 150 communicates vacuum from the waste water tank 146 to the carpet cleaning wand 172*a*. The carpet cleaning wand 172*a* then communicates vacuum to the floor as suction and extracts the sprayable rinse from the carpet.

High pressure washing is accomplished in the same manner as above except the water pressure regulator 156 is adjusted is to an appropriate higher pressure according to the task. Marble, tile and grout are cleaned at medium to high pressure (1500 to 2000 psi) while restaurant exhaust hoods and loading docks are cleaned at very high pressures (2500 to 3000 psi). The pressure washing gun 172*b* is attached to the water hose 160 by a quick connect fitting 200. The pressure washing gun 172*b* is then triggered to release a directed spray of hot water at a selected pressure for addressing the surface to be cleaned. High pressure washing is typically performed without extraction.

Similarly, drain cleaning is a high pressure washing procedure without extraction. The water pressure used for drain cleaning is determined by the type and condition of the drain to be cleaned. Water pressures of 1500 to 3000 psi can be used. In general, metal drains can be cleaned at higher pressures than drains made of polyvinylchloride (PVC). The tri-jet high pressure cleaning snake 172*c* is attached to the water hose 160 by a quick connect fitting 200. The water pump 44 is reconfigured for this particular task by opening a bypass to one of the three cylinders in the water pump. This renders the cylinder inoperative and causes a "pulsation effect" which is useful in drain cleaning. A ball valve is opened (not illustrated) releasing pulsating hot water at a selected pressure from the tri-jet high pressure cleaning snake 172*c* into the drain being cleaned.

With reference to FIG. 5, the integrated cleaning apparatus 10 is used for air duct cleaning and various services performed with air or electric tools. In the is illustrated embodiment, the integrated cleaning apparatus is configured for "push-pull" air duct cleaning of the return air ducts 190. Also in the illustrated embodiment, the integrated cleaning apparatus 10 is configured for operating the air sprayer 250, the air staple gun 252, the electric table saw 254 and the electric lights 256.

To perform air duct cleaning, the integrated cleaning apparatus 10 is activated to power the air compressor 34 and the electric generator 66. Once the air compressor 34 has cycled off, a red indicator light 189 shuts off indicating that the air receiving tank 184 is fully charged and full horsepower is available to start the air mover 220. The air pressure gauge 183 on the air receiving tank 184 reads 195 psi.

The air mover 220 is positioned adjacent the central air handler 206. The return air ducts 190 and plenum 210 are isolated from the supply air ducts 207; for example, by placing a plastic bag over the air filter 208 and reinserting the covered air filter into the air handler 206 (not illustrated). An opening is made in the return air plenum 210 and a furnace flange 214 is attached over the opening. A flexible hose 222 connects the furnace flange 214 to the round air inlet 301 of the air mover 220. A is flexible hose 224 connects the round exhaust air outlet 341 of the air mover 220 to the exhaust diffuser 901 or the air-permeable collection bag 226.

A suitable electrical drop cord 234 communicates between the air mover 220 and the integrated cleaning apparatus 10. The air mover 220 is started, requiring 82% full horsepower from the gas engine 70. Once in operation the air mover 220 requires only 41% full horsepower. As well, the compressor 34 can cycle (requiring 32% full horsepower) to replenish the air receiver tank 184 as needed while the air mover 220 is operating. The motor speed of the air mover 220 and resultant air flow are then adjusted. Generally, metal air ducts are cleaned at higher vacuums and flows than either fiberglass or flexible air ducts.

Sample air velocities are taken by hand-held anemometer at the registers of the air ducts 190 to be cleaned. The registers are removed. Often the openings to the various air ducts being cleaned 190 are blocked off with foam rubber inserts to increase vacuum and air flow through a particular air duct. In turn a "clean" air duct is blocked as a "dirty" air duct is unblocked and cleaned (not illustrated).

The high pressure air hose 188 terminating at a quick connect fitting 195 extends from the integrated cleaning apparatus 10, through a doorway 192 into the building being cleaned. The ball valve 197 attaches to the quick connect fitting 195. Air rods 196 attach to the ball valve 197. The air rods 196 terminate at the video air tool 400. Various pressure attachments such as air whips 198, forward skipper balls 199 and reverse skipper balls 201 connect to the video air tool 400 for air washing purposes.

In the illustrated embodiment an air whip 198 and forward skipper ball 199 "push" dislodged dust and debris toward the air mover 220. Conversely, a reverse skipper ball 201 "pulls" dust and debris toward the air mover 220. The video air tool 400 and pressure attachments the air whip 198, forward skipper ball 199 and reverse skipper ball 201 are manually inserted into the return air ducts 190 at the air duct openings or through pre-drilled one inch holes. Pressure attachments like the air whip 198, the forward skipper ball 199 and the reverse skipper ball 201 are variously triggered by a ball valve 197 in five or ten second bursts causing them to bounce about erratically or flagellate within the return air-ducts 190.

As illustrated, the duct cleaning brush 244 operated by the electric drill 240 is also used to dislodge dust and debris particularly in round ducts. The timing module 242 which causes the duct cleaning brush 244 to variously change direction of rotation improves the effectiveness of the duct cleaning brush 244.

It is to be appreciated that while the air mover 220 pulls vacuum through the return air ducts 190 and pushes exhaust out of the building through the exhaust diffuser 901 or collection bag 226, the video air tool 400 with its pressure attachments the air whip 198, the forward skipper ball 199 and the reverse skipper ball 201 as well as the duct cleaning brush 244 simultaneously dislodge dust and debris to be evacuated. Hence, air duct cleaning takes place as the pressure attachments are moved through the ducts together with video imaging of progress.

Once cleaning of the air return ducts 190 are completed, the air supply ducts are cleaned in the same manner. As a final step the air handler 206 and blower 205 are vacuumed thoroughly and the HVAC system may be "fogged" with a disinfectant.

The air duct cleaning process is monitored by the video air tool 400. Images received by the VCR and monitor 204 determine the overall condition of the HVAC system before and after the air duct cleaning. HVAC system defects and repair needs are documented. Upon completion all information is presented to the customer.

In the illustrated embodiment the integrated cleaning apparatus 10 is shown operating air tools like the air sprayer 250 and air staple gun 252. It is to be appreciated that the stored air in the air receiving tank 184 can be regulated by the air pressure regulator 187 to pressures below that used for air duct cleaning. For example compressed air at 90 psi is commonly used to operate air powered tools such as the air staple gun 252. Even lower pressures of 35 to 45 psi are used to operate the air sprayer 250.

In the illustrated embodiment, the integrated cleaning apparatus 10 is shown operating electric tools like the electric table saw 254 and the work lights 256. It is to be appreciated that the output of the electric generator 66 can be regulated for voltages less than that used to run the air mover 220. More specifically 120 volts is used to operate electric tools up to 1.75 hp like the work lights 256 and table saw 254. The 240 volt output of the electric generator will run most electric tools up to 5.0 hp or devices requiring up to 8000 watts. In addition, the integrated cleaning apparatus 10 is convertible for portable welding (not illustrated). The extended van 501 provides ample storage area for the compressed gases used in MIG, TIG and other types of welding. Adding two simple amperage controllers and a few hand tools converts the integrated cleaning apparatus 10 to a portable welding device.

With reference to FIG. 6, the air mover 220 can also function as a vacuum or blower for drying carpets, walls and floors subjected to water damage. Often, wall and floor systems can be blown dry or evacuated to prevent mildew and other degradation by moisture. Generally this is accomplished by placing several small (1000 cfm) electric blowers in affected areas and connecting them to drying equipment (not illustrated). However, the set-up for this procedure is time consuming. Also, power outages are common during severe weather conditions and moisture abatement becomes even more complicated.

During a power "black-out", the integrated cleaning apparatus 10 will simultaneously operate the 5000 cfm air mover 220 and work lighting 256 up to 4000 watts. The 5000 cfm air mover 220 provides about five times the air flow and ten times the static pressure handling capability of the above mentioned small electric blowers. Either the exhaust air outlet 341 or air intake 301 of the air mover 220 can be connected to a plurality of flexible hoses (not illustrated). For example, a central plenum communicating with the air mover 220 provides air flow to a plurality of hoses used to distribute large volumes of air under vacuum or pressure to drying equipment in affected areas. Use of the air mover 220 and the integrated cleaning apparatus 10 will hasten and simplify the set-up for moisture abatement procedures in most cases.

The present invention accordingly provides an improved integrated cleaning apparatus that readily converts for performing the following services; low pressure washing with extraction for carpets etc., high pressure washing for building exteriors, drain cleaning etc., air washing with evacuation and video inspection for air ducts, services performed with air tools or sprayers etc., services performed with electric tools or lights etc., welding services, and moisture abatement. A single source dedicated service apparatus; van mounted.

The principles, preferred embodiments, and modes of operation of the present invention have been described in the foregoing specification. The invention is not to be construed as limited to the particular forms disclosed because these are regarded as illustrative rather than restrictive. Moreover, variations and changes may be made by those skilled in the art without departure from the spirit of the invention as described in the following claims.

What is claimed is:

1. An integrated apparatus for carpet cleaning, duct cleaning, and pressure washing services, comprising:

a frame having a first platform and a second spaced-apart second platform;

a gas engine mounted to the first platform;

a blower mounted to the first platform aligned with the gas engine;

a flex coupler connecting a drive shaft of the blower to a drive shaft of the gas engine;

an electric generator attached to the first platform in alignment with the blower;

a water pump mounted to the second platform and operatively connected by a serpentine belt to the drive shaft of the blower and to the electric generator; and an air compressor mounted to the second platform and operatively connected by a drive belt to the shaft of the gas engine, whereby the gas engine drives the blower, the air compressor, the electric generator, and the water pump for selective configuration and use for carpet cleaning, air duct cleaning, pressure washing and other services.

2. The apparatus as recited in claim 1, further comprising a spray nozzle for attaching to a hose connected to a discharge outlet of the water heater.

3. The apparatus as recited in claim 1, further comprising:

a video air tool housing a camera and an air extension tube also for communicating pressurized air to pressure attachments for dislodging debris from the interior walls of a duct; and an air mover for creating suction within a duct for extracting dislodged debris.

4. The apparatus as recited in claim 1, further comprising:

a spray nozzle connected by a hose to a discharge outlet of the water heater, for communicating a rinse fluid there from to a fabric to be cleaned of soils; and a suction hose connected through a collection tank to a suction side of the blower and a distal end of the hose operatively associated with the spray nozzle, whereby the apparatus sprays rinse fluid to the fabric to be cleaned while the suction hose removes the rinse fluid from the surface.

5. The apparatus as recited in claim 1, further comprising a belt tensioning assembly operatively engaged to the drive belts.

6. The apparatus as recited in claim 5, wherein the belt tensioning assembly comprises:

opposing supports for two shafts;

a pair of pulleys attached to the shafts for engaging the respective drive belts intermediate the gas engine and the blower, the electric generator, and the water pump; and a pair of positioners for selectively moving the shaft to tighten the drive belts against the pulleys.

7. The apparatus as recited in claim 6, wherein the support comprises a pair of parallel spaced-apart arms each having seats for receiving respective opposing distal ends of the shafts.

8. The apparatus as recited in claim 7, wherein the positioner comprises a pair of adjusters for selectively positioning the seats in the arms to tighten the engagement of the drive belts relative to the third and fourth pulleys.

9. The apparatus as recited in claim 1, further comprising a imaging support for observing the duct cleaning process, comprising:

an air extension tube connected at a first end to a supply of pressurized air and at a second end to a pressure attachment to dislodge debris from walls of a duct;

a camera mount attached to the air extension tube and supporting a camera;

an array of lights disposed about the camera, whereby the lights illuminate in a direction towards the pressure attachement.

10. The apparatus as recited in claim 9, wherein a portion of the elongate tube near the second end defines a plurality of forwardly angled ports which communicate pressurized air forwardly of the imaging support for duct cleaning.

11. The apparatus as recited in claim 9, wherein the camera mount is disposed within a housing connected to the elongate tube.

12. The apparatus as recited in claim 1, further comprising an air mover for communicating a vacuum for air duct cleaning and moisture abatement comprising:

an integral dolly having a frame; and a fan housing attached to the frame and enclosing a fan, the fan housing defining an air intake and an air outlet, whereby the air mover is movable into close proximity to an access port for the ducting.

13. The apparatus as recited in claim 12, wherein the frame comprises telescoping opposing rails, whereby a first portion slidably extends from a second portion to which the fan housing connects, for an extended handle for wheeling the air mover to a selected location for use.

14. The apparatus as recited in claim 13, further comprising a transverse member extending between the opposing rails of the first portion, for gripping in order to wheel the air mover.

15. The apparatus as recited in claim 14, further comprising rollers attached to the distal ends of the rails the first portion to facilitate moving the air mover in and out of a vehicle.

16. The apparatus as recited in claim 1, further comprising an air diffuser attached to an air exhaust hose for communicating dust and debris out of a building during duct cleaning process.

17. The apparatus as recited in claim 16, wherein the air diffuser comprises:

a diffuser housing transitioning from a circular air exhaust hose to a rectangular discharge outlet;

a seal extending from the diffuser housing for sealing air flow through a doorway used for discharging exhaust air from a building; and a bracket attached to the diffuser housing for connecting to an edge of a door.

18. An integrated apparatus for carpet cleaning, duct cleaning, and pressure washing services, comprising:

a gas engine mounted to a frame and having a drive shaft extending therefrom;

a blower, an air compressor, an electric generator and a water pump mounted to the frame, the water pump for connecting to a supply of water, each having a respective drive shaft and disposed on the frame with the gas engine in opposing relation to the blower, on a second platform the air compressor in opposing relation to the water pump, and the electric generator in alignment between the blower and water pump opposing the other two;

a flex coupler connecting the drive shaft of the gas engine to the the blower; and a pair of endless belts operatively engaged to the drive shaft of the gas engine and to the other respective drive shafts of the blower, the air compressor, the electric generator, and the water pump; whereby the gas engine drives the blower, the air compressor, the electric generator, and the water pump for selective configuration and use for carpet cleaning, duct cleaning, pressure washing and other maintenance and repair services.

19. The apparatus as recited in claim 18, further comprising a spray nozzle for attaching to a hose connected to an outlet of the water heater.

20. The apparatus as recited in claim 19, further comprising a pressure regulator for selectively controlling the pressure of the water communicated to the spray nozzle, such as low pressure for carpet cleaning and a high pressure for pressure washing.

21. The apparatus as recited in claim 18, wherein electric power tools for rotary brushing air ducts and other tasks are powered by a battery pack selectively recharged by electrical current communicated from the electric generator.

22. The apparatus as recited in claim 18, further comprising a tool actuated by compressed air communicated to the tool from the air compressor for performing cleaning or maintenance functions.

23. The apparatus as recited in claim 18, further comprising a tool actuated by electrical current communicated to the tool from the electrical generator for performing cleaning or maintenance functions.

24. The apparatus as recited in claim 18, further comprising:

a spray nozzle connected by a hose to a discharge outlet of the water heater, for communicating a rinse fluid to a fabric material to be cleaned of soils; and a suction hose connected though a collection tank to a suction side of the blower and a second end of the hose operatively associated with the spray nozzle, whereby the spray nozzle sprays the rinse fluid onto the fabric surface to be cleaned while the suction hose extracts the rinse fluid and dislodged soils from the fabric material for being received in the collection tank.

25. The apparatus as recited in claim 18, further comprising a belt tensioning assembly operatively engaged to the endless belts.

26. The apparatus as recited in claim 25, wherein the air diffuser comprises:

a diffuser housing transitioning from a circular air exhaust hose to a rectangular discharge outlet;

a seal extending from the diffuser housing for sealing air flow through a doorway used for discharging exhaust air from a building; and a bracket attached to the diffuser housing for connecting to an edge of a door.

27. The apparatus as recited in claim 25, wherein the belt tensioning assembly comprises:

opposing supports for two shafts;

at least two pulleys attached to the shafts for engaging the respective endless belts intermediate the drive shaft of the gas engine and the others of the blower, the air compressor, the electric generator, and the water pump; and two positioners for selectively moving the shafts to tighten the endless belts against the pulleys.

28. The apparatus as recited in claim 27, wherein the supports comprises a pair of parallel spaced-apart arms each having seats for receiving respective opposing distal ends of the shafts.

29. The apparatus as recited in claim 27, wherein the positioner comprises a pair of adjusters for selectively positioning the seats in the arms to tighten the engagement of the drive belts relative to the two pulleys on the shaft.

30. The apparatus as recited in claim 18, further comprising a imaging support for observing a duct cleaning process, comprising:

an air extension tube connected at a first end to a supply of pressurized air and at a second end to a pressure attachment, whereby the air communicated through the pressure attachment dislodges debris from walls of a duct;

a camera mount attached to the air extension tube and supporting a camera;

an array of lights disposed about the camera, whereby the lights illuminate in a direction towards the pressure attachment.

31. The apparatus as recited in claim 30, wherein a portion of the elongate tube near the second end defines a plurality of forwardly angled ports which communicate pressurized air forwardly of the imaging support for air duct cleaning.

32. The apparatus as recited in claim 31, further comprising an air mover for communicating a vacuum for air duct cleaning or moisture abatement comprising:

an integral dolly having a lower frame and an upper frame telescopically extendable therefrom; and a fan housing attached to the lower frame and enclosing a fan, the fan housing defining an air intake and an air outlet, whereby the air mover is movable into close proximity to an access port for the ducting.

33. The apparatus as recited in claim 32, further comprising a pair of spaced-apart wheels extending from the fan housing on a side opposing the frame, for moving the air mover in and out of a vehicle; and a pair of handles attached to the housing for gripping the air mover during movement in and out of the vehicle.

34. The apparatus as recited in claim 1, further comprising a transverse member disposed in the upper frame, for gripping in order to wheel the air mover.

35. The apparatus as recited in claim 34, further comprising rollers attached to the transverse member to facilitate moving the air mover in and out of a vehicle.

36. The apparatus as recited in claim 18, further comprising an air diffuser attached to an air exhaust hose for communicating dust and debris out of a building during duct cleaning process.

37. An integrated apparatus for carpet cleaning, duct cleaning, and pressure washing services, comprising:

a gas engine mounted to a frame and having a drive shaft extending therefrom;

a blower, an air compressor, an electric generator and a water pump mounted to the frame, the water pump for connecting to a supply of water, each having a respective drive shaft and disposed on the frame in spaced-apart relation;

a coupler connecting the drive shaft of the gas engine to an aligned one of the blower, the air compressor, and the water pump; and a pair of endless belts operatively engaged to the drive shaft of the gas engine and to the other respective drive shafts of the blower, the air compressor, the electric generator, and the water pump; whereby the gas engine drives the blower, the air compressor, the electric generator, and the water pump for selective configuration and use for carpet cleaning, duct cleaning, pressure washing and other maintenance and repair services.

38. The integrated apparatus as recited in claim 37, further comprising a spray nozzle for attaching to a hose connected to an outlet of the water heater.

39. The integrated apparatus as recited in claim 37, further comprising a tool actuated by compressed air communicated to the tool from the air compressor for performing cleaning or maintenance functions.

40. The integrated apparatus as recited in claim 37, further comprising:

a spray nozzle connected by a hose to a discharge outlet of the water heater, for communicating a rinse fluid to a fabric material to be cleaned of soils; and a suction hose connected though a collection tank to a suction side of the blower and a second end of the hose operatively associated with the spray nozzle, whereby the spray nozzle sprays the rinse fluid onto the fabric surface to be cleaned while the suction hose extracts the rinse fluid and dislodged soils from the fabric material for being received in the collection tank.

41. The integrated apparatus as recited in claim 37, further comprising a belt tensioning assembly operatively engaged to the endless belts.

42. The integrated apparatus as recited in claim 37, further comprising a imaging support for observing a duct cleaning process, comprising:

an air extension tube connected at a first end to a supply of pressurized air and at a second end to a pressure attachment, whereby the air communicated through the pressure attachment dislodges debris from walls of a duct;

a camera mount attached to the air extension tube and supporting a camera;

an array of lights disposed about the camera, whereby the lights illuminate in a direction towards the pressure attachment.

43. The integrated apparatus as recited in claim 37, further comprising an air mover for communicating a vacuum for air duct cleaning or moisture abatement comprising:

a fan housing attached to the lower frame and enclosing a fan, the fan housing defining an air intake and an air outlet, whereby the air mover is movable into close proximity to an access port for the ducting.

44. The integrated apparatus as recited in claim 43, further comprising:

an integral dolly attached to the fan housing and having a lower frame and an upper frame telescopically extendable therefrom;

a pair of spaced-apart wheels extending from the fan housing on a side opposing the frame, for moving the air mover in and out of a vehicle; and a pair of handles attached to the housing for gripping the air mover during movement in and out of the vehicle.

45. The integrated apparatus as recited in claim 37, further comprising an air diffuser attached to an air exhaust hose for communicating dust and debris out of a building during duct cleaning process.

46. The integrated apparatus as recited in claim 45, wherein the air diffuser comprises:

a diffuser housing transitioning from a circular air exhaust hose to a rectangular discharge outlet;

a seal extending from the diffuser housing for sealing air flow through a doorway used for discharging exhaust air from a building; and a bracket attached to the diffuser housing for connecting to an edge of a door.

* * * * *